US010669785B1

(12) United States Patent
Allen et al.

(10) Patent No.: US 10,669,785 B1
(45) Date of Patent: Jun. 2, 2020

(54) VIV SUPPRESSION DEVICES WITH BUOYANCY MODULES

(71) Applicant: VIV Solutions LLC, Richmond, TX (US)

(72) Inventors: Donald Wayne Allen, Richmond, TX (US); Julie Ann Dehne, Cypress, TX (US); Jeffrey Robert Dupuis, Houston, TX (US)

(73) Assignee: VIV Solutions LLC, Richmond, TX (US)

( * ) Notice: Subject to any disclaimer, the term of this patent is extended or adjusted under 35 U.S.C. 154(b) by 0 days.

(21) Appl. No.: 16/117,640

(22) Filed: Aug. 30, 2018

Related U.S. Application Data

(60) Provisional application No. 62/552,030, filed on Aug. 30, 2017, provisional application No. 62/576,073, filed on Oct. 23, 2017, provisional application No. 62/641,932, filed on Mar. 12, 2018.

(51) Int. Cl.
*E21B 17/01* (2006.01)

(52) U.S. Cl.
CPC ..... *E21B 17/012* (2013.01)

(58) Field of Classification Search
CPC B63B 2021/504; E02B 17/003; E21B 17/012
See application file for complete search history.

(56) References Cited

U.S. PATENT DOCUMENTS 4,398,487 A * 8/1983 Ortloff ..... B63B 1/32 114/243
4,474,129 A 10/1984 Watkins et al.
4,640,537 A * 2/1987 Chaix ..... F16L 23/032 285/332.2
5,018,471 A 5/1991 Stevens
5,115,541 A 5/1992 Stichel
5,309,607 A 5/1994 Hohmann et al.
5,435,667 A 7/1995 Strange
6,000,104 A 12/1999 Mann
6,010,278 A 1/2000 Denison et al.
6,048,136 A 4/2000 Denison et al.
6,223,672 B1 5/2001 Allen et al.
6,347,911 B1 2/2002 Blair et al.
6,367,846 B1 * 4/2002 Aaron, III ..... E21B 17/012 166/335
6,896,447 B1 5/2005 Taquino
7,017,666 B1 3/2006 Allen et al.
7,458,752 B2 12/2008 Esselbrugge et al.
7,845,299 B2 12/2010 Masters et al.
(Continued)

FOREIGN PATENT DOCUMENTS

WO WO2008/087372 A1 7/2008

*Primary Examiner* — James G Sayre

(74) *Attorney, Agent, or Firm* — Womble Bond Dickinson (US) LLP

(57) ABSTRACT

A vortex induced vibration suppression system including a buoyancy module dimensioned to at least partially encircle an underlying tubular, the buoyancy module having an exterior surface and a groove formed inwardly from the exterior surface; and a collar dimensioned to at least partially encircle the underlying tubular, the collar having a web, a set of flanges extending from the web, and at least one engaging member dimensioned to engage with the buoyancy module, when the collar is positioned around the underlying tubular.

22 Claims, 28 Drawing Sheets

(56) References Cited

U.S. PATENT DOCUMENTS

| | | | | |
|---|---|---|---|---|
| 9,074,426 | B1 | 7/2015 | West et al. | |
| 9,080,610 | B1 | 7/2015 | West et al. | |
| 9,163,781 | B2 | 10/2015 | Allen et al. | |
| 2002/0112858 | A1* | 8/2002 | McDaniel | E21B 17/012 166/350 |
| 2002/0146287 | A1 | 10/2002 | Allen et al. | |
| 2003/0000152 | A1 | 1/2003 | Ryan | |
| 2007/0104542 | A1* | 5/2007 | Somerville | B63B 21/663 405/224.1 |
| 2008/0025800 | A1 | 1/2008 | Watkins | |
| 2008/0050181 | A1 | 2/2008 | Masters et al. | |
| 2008/0098572 | A1 | 5/2008 | Krauss | |
| 2008/0236469 | A1 | 10/2008 | Masters et al. | |
| 2008/0251668 | A1* | 10/2008 | Stokes | E21B 17/012 248/230.4 |
| 2009/0185868 | A1 | 7/2009 | Masters et al. | |
| 2010/0061809 | A1 | 3/2010 | Allen et al. | |
| 2010/0119308 | A1 | 5/2010 | Somerville et al. | |
| 2010/0150662 | A1 | 6/2010 | Allen et al. | |
| 2011/0074074 | A1 | 5/2011 | Masters et al. | |
| 2012/0006053 | A1 | 1/2012 | Allen et al. | |

* cited by examiner

VIV SUPPRESSION DEVICES WITH BUOYANCY MODULES

CROSS-REFERENCE TO RELATED APPLICATION

The application is a non-provisional application of U.S. Provisional Patent Application No. 62/552,030, filed Aug. 30, 2017, U.S. Provisional Patent Application No. 62/576,073, filed Oct. 23, 2017, and U.S. Provisional Patent Application No. 62/641,932, filed Mar. 12, 2018, all of which are incorporated herein by reference.

FIELD

A vortex-induced suppression (VIV) system with buoyancy and/or insulation modules and collars. Other embodiments are also described herein.

BACKGROUND

A difficult obstacle associated with the exploration and production of oil and gas is management of significant ocean currents. These currents can produce vortex-induced vibration (VIV) and/or large deflections of tubulars associated with drilling and production. VIV can cause substantial fatigue damage to the tubular or cause suspension of drilling due to increased deflections. Deflections of both production and drilling tubulars can be alleviated using various types of VIV suppression devices that can be attached to the tubular, for example, fairings, tail fairings, strakes, or other suppression systems.

Fairings may have a substantially triangular or tear drop shape, and work by streamlining the current flow past the tubular and thereby reduce the intensity of vortex shedding. With weaker vortices, both VIV and drag or deflection of the underlying tubular can be decreased.

Fairings may be constrained axially by collars. These collars are clamped tight around the tubular so that the fairings may be free to rotate with changes in current direction and restricted from sliding axially past the collar. Various arrangements of collars and fairings are possible.

An issue associated with drilling riser fairings is that they can be time consuming to install. Of the installation time, usually well over half is due to the time it takes to install the collars. While it would be beneficial to be able to install the collars quickly, it would also be beneficial to be able to pre-install the collars in the yard or in storage rather than install them during installation of the riser. These needs are also true of collars used on production tubulars, which can have insulation, buoyancy or other thick coatings.

Buoyancy is often required for drilling risers, especially those operating in deeper waters. Buoyancy reduces the amount of weight that the vessel has to support so that lighter and smaller vessels can drill effectively. Buoyancy also influences the dynamics of the entire drill string including the wellhead.

Insulation is often required for production tubulars in order to keep the production fluids at a temperature that optimizes production. Like buoyancy, insulation is typically preinstalled on the tubular and can have a range of thicknesses.

Some tubulars, especially drilling risers, can have auxiliary lines external to the main tubular. The lines can potentially impede the rotation of the fairing that covers the main tubular and the auxiliary lines. In addition, the lines must pass over or through the collars as they travel axially along the main tubular.

SUMMARY

The instant invention is directed to a VIV suppression system including collars and/or buoyancy modules, for example, grooved buoyancy modules. In this aspect, the instant invention provides various advantages, for example, a collar that is fast to install, a collar that can be installed prior to installation of the underlying tubular or riser, a collar that can utilize the underlying buoyancy, insulation, or other similar coatings or appurtenances, a buoyancy module or insulation that can accommodate fairings and/or their associated collars or eliminate the need for collars for other VIV devices (e.g., helical strakes). Representatively, the instant invention is directed to systems and methodologies for accommodating collars using one or more grooves in the outer layer of the tubular, e.g. buoyancy or insulation, systems and methodologies for installing fairings or other VIV suppression devices requiring some axial restraint using alterations to the outer layer of the tubular, e.g. the buoyancy or insulation, and/or systems and methodologies for installing collars or other devices that provide some axial restraint of adjacent VIV suppression devices by using alterations to the outer layer of the tubular, e.g. the buoyancy or insulation.

Representatively, in one embodiment, the invention includes a vortex induced vibration suppression system comprising a buoyancy module dimensioned to at least partially encircle an underlying tubular, the buoyancy module having an exterior surface and a groove formed inwardly from the exterior surface; and a collar dimensioned to at least partially encircle the underlying tubular, the collar having a web, a set of flanges extending from the web, and at least one engaging member dimensioned to engage with the buoyancy module, when the collar is positioned around the underlying tubular. The groove may be dimensioned to receive the collar. For example, the groove may include a sidewall, and an axially oriented slot for engaging with the engaging member of the collar is formed in the sidewall. In some aspects, the engaging member may be a spring that extends from a top side or a bottom side of the web. In addition, in some cases, the buoyancy module is a first buoyancy module, the system further includes a second buoyancy module, and the engaging member of the collar is dimensioned to engage with a gap between the first buoyancy module and the second buoyancy module. In this aspect, the engaging member may extend from the web in a radial direction, toward the underlying tubular, and is dimensioned to be inserted within the gap. In some aspects, the set of flanges are a set of inner flanges, and the collar further includes a set of outer flanges. The set of outer flanges are hinged to the set of inner flanges, and the outer flanges are operable to be retraced or extended to change an overall flange length of the collar. The buoyancy module may further include a protruding member extending from an outer surface of the buoyancy module, and the protruding member is dimensioned to support a VIV suppression device. The collar may include a spring extending from a surface of the web facing the underlying tubular. In addition, the system may include a collar protector coupled to the buoyancy module and the collar.

In another embodiment, a buoyancy module is disclosed. The buoyancy module may be dimensioned to at least partially encircle an underlying tubular, and include an exterior surface, a radially oriented groove formed inwardly from the exterior surface, and an axially oriented slot formed within a sidewall of the groove, and the groove is dimensioned to receive a collar, and the slot is dimensioned to engage with a portion of the collar. In addition, a collar may be provided. The collar may be dimensioned to at least partially encircle the buoyancy module, the collar having a web, a set of flanges extending from the web, and at least one axially oriented engaging member dimensioned to engage with the axially oriented slot. In some cases, the at least one axially oriented engaging member includes a spring, and the spring is operable to contract when the collar is being inserted into the groove and expand once the spring is aligned with the slot. In some cases, the radially oriented groove is formed around an entire circumference of the buoyancy module. In addition, the axially oriented slot may be formed around an entire circumference of the buoyancy module.

The above summary does not include an exhaustive list of all aspects of the present invention. It is contemplated that the invention includes all apparatuses that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments disclosed herein are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

The terminology used herein is for the purpose of describing particular aspects only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1A:
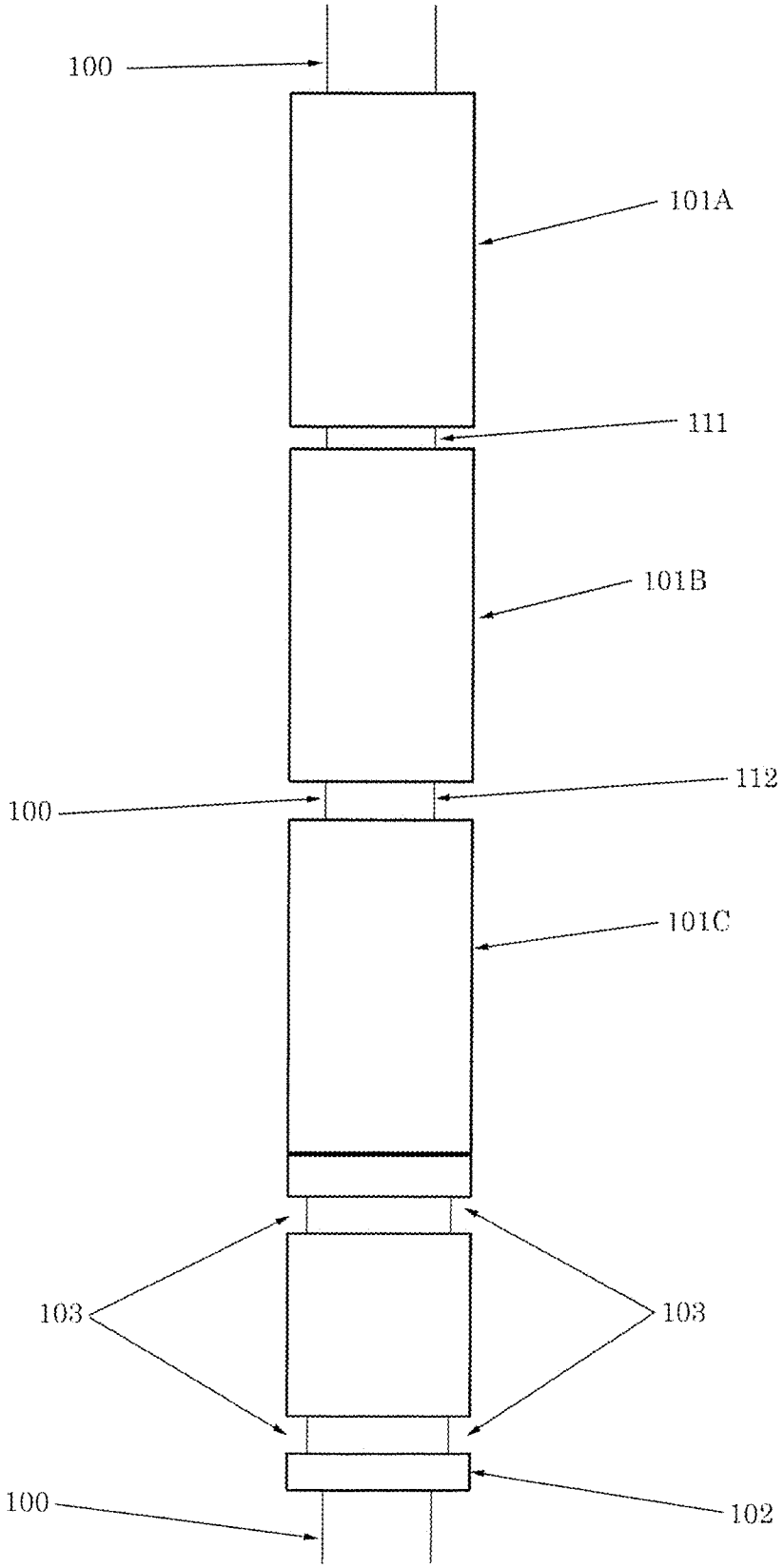
FIG. 1A is a side view of a tubular with buoyancy modules.

Referring now to the invention in more detail, FIG. 1A shows buoyancy modules 101A, 101B, 101C, and grooved buoyancy module 102 on tubular 100. Gap 111 separates buoyancy modules 101A and 101B, and gap 112 separates buoyancy modules 101B and 101C. Grooves 103 are in buoyancy module 102, for example, grooves 103 may be recessed regions formed within an outer surface of buoyancy module 102.

Again referring to FIG. 1A, buoyancy modules 101A, 101B, 101C, and grooved buoyancy module 102 are attached to tubular 100 by clamping, banding, or by any suitable means. A singular tubular 100 may be present or any number of adjacent tubulars may be present (it is common for drilling risers to have other auxiliary or control lines parallel and adjacent to the main tubular 100). A tubular may have any number of buoyancy modules 101A, 101B, and 101C or grooved buoyancy modules similar to grooved buoyancy module 102. A single riser joint may have any combination of buoyancy modules or grooved buoyancy modules or any other types of buoyancy modules. Insulated sections may be substituted for buoyancy modules 101A, 101B, 101C, and grooved buoyancy module 102 in FIG. 1A and throughout this application. Buoyancy modules 101A, 101B, 101C, and grooved buoyancy module 102 may have an overall cylindrical shape and be dimensioned to encircle underlying tubular 100. In some aspects, buoyancy modules 101A101C and/or grooved buoyancy module 102 may include two halves that each make up about one half of the circumference around tubular 100. In other embodiments, buoyancy modules 101A101C and/or grooved buoyancy module 102 may be made in any number of circumferential portions, and each portion may cover less than half of the circumference of tubular 100, for example, ⅓ a circumference, ¼ a circumference, or ⅛ a circumference, of tubular 100.

Still referring to FIG. 1A, adjacent buoyancy modules may be separated by gaps of any size such as gaps 111 and 112 or may have no significant gap at all such as buoyancy module 101C and grooved buoyancy module 102. When gaps 111 and 112 are present, buoyancy modules 101A-101C may be used to support the weight of fairings, collars or other VIV suppression devices or their components, positioned within the gaps. Buoyancy modules 101A, 101B, 101C, and 102 may be supported by clamps, banding, or other devices to restrain them axially relative to tubular 100.

Grooved buoyancy module 102 may contain any number of grooves 103. Grooves 103 may run the full circumference of grooved buoyancy module 102 or may run only part of the circumference of grooved buoyancy module 102. Grooves 103 may consist of more than one circumferential portion so that multiple grooves may present at a single location on grooved buoyancy module 102. In some aspects, grooves 103 may be pockets or holes formed in the outer surface of buoyancy module 102. Standard buoyancy modules 101A, 101B, 101C, and grooved buoyancy module 102 may be made of any suitable shape and may have a cross section that is of any suitable shape. Grooves 103 may also be used to support the weight of fairings, collars or other VIV suppression devices or their components.

Still referring to FIG. 1A, buoyancy modules 101A, 101B, 101C, and grooved buoyancy module 102 may be made of any suitable material including, but not limited to, syntactic foam, fiberglass, plastic, metal, ceramic, synthetic, air or other fluid, or any combination thereof.

Still referring to FIG. 1A, any number of buoyancy modules 101A, 101B, 101C, and 102 may be present on tubular 100. Any number of gaps 111 and 112 may be present and gaps 111 and gaps 112 may be of any suitable size and shape. While FIG. 1A shows gaps 111 and 112 present around the entire circumference of tubular 100, they may be less than the entire circumference of tubular 100 and thus the buoyancy modules may contact each other but have openings at their ends so that there is a gap between adjacent buoyancy modules for part of their circumference. Any number of grooves 103 may be present and the grooves, which do not have to be identical, may be of any size and shape.

Buoyancy modules 101A, 101B, 101C, and 102 may also have other appurtenances or openings present including, but not limited to, mux clamps, gaps between halves, bands, flats, or other VIV suppression devices or components. Insulation or other outer coatings may be present in place of, or in addition to, buoyancy modules 101A, 101B, 101C, and 102.

Figure 1B:
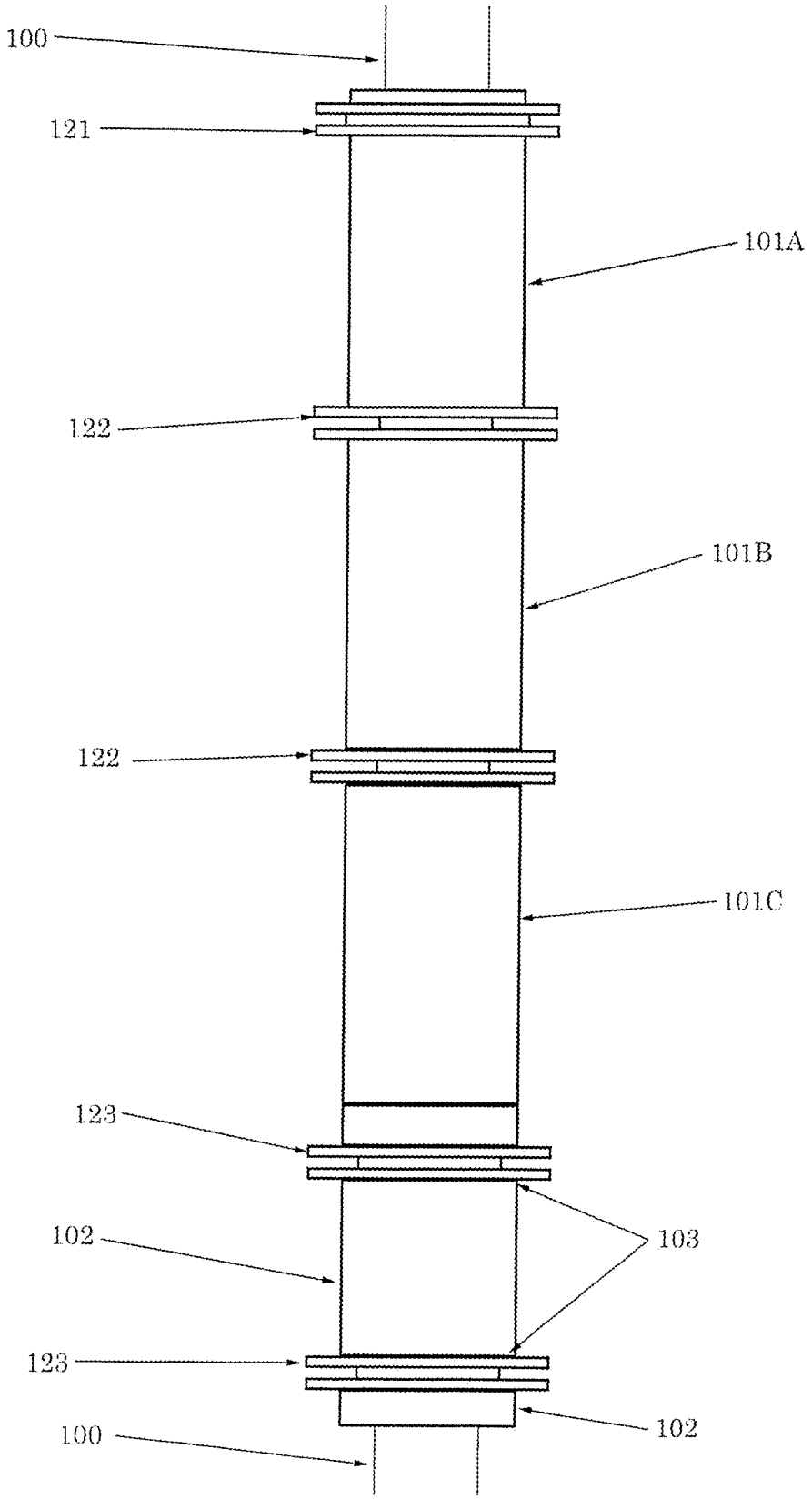
FIG. 1B is side view of a tubular with buoyancy modules and collars.

Referring now to FIG. 1B, this figure shows standard buoyancy modules 101A, 101B, 101C, and grooved buoyancy module 102 on tubular 100. Grooves 103 are in buoyancy module 102 (e.g. formed inwardly from an outer surface of module 102). In addition, FIG. 1B shows collars 121, 122 and 123 positioned, in various ways, around tubular 100. Representatively, collar 121 is shown on buoyancy module 101A (e.g., around an outer surface of module 101A), collars 122 are positioned in the gaps (e.g., gaps 111 and 112) between the ends of buoyancy module 101B and adjacent modules 101A, 101C, and collars 123 are positioned in grooves 103 on grooved buoyancy module 102.

Again referring to FIG. 1B, collar 121 may be clamped tight against buoyancy module 101A. Representatively, collar 121 may be made in two circumferential halves, though it can be divided into any number of circumferential portions or may be made in a single circumferential section that covers all, or a part, of the circumference of buoyancy module 101A. Likewise, each circumferential portion of collar 121 may cover all, or a part, of the circumference of buoyancy module 101A. Collars 122 are optionally clamped tight against tubular 100 (or tubulars adjacent to tubular 100 as noted previously). In some cases, collars 122 are not necessarily clamped tight against tubular 100 since they can resist axial movement by virtue of presence of the adjacent buoyancy modules that may be utilized to resist axial movement of collars 122. It is important that collars 122 remain in a closed position (around the circumference of tubular 100) so that they do not come off of tubular 100. Similarly, in some cases, collars 123 are not necessarily clamped tight against grooved buoyancy module 102 since they can resist axial movement by virtue of the presence of grooves 103, but should remain in a closed position around grooved buoyancy module 102.

Still referring to FIG. 1B, any number of collars 121, 122, and 123 may be present on a given tubular or joint of a tubular. While collars 121, 122, and 123 are typically circular, they may be of any suitable geometry and of any suitable length along tubular 100, standard buoyancy modules 101A, 101B, 101C, or grooved buoyancy module 102. Collars 121, 122, and 123 may be hinged, bolted, or closed around tubular 100, standard buoyancy modules 101A, 101B, 101C, or grooved buoyancy module 102 by any suitable means. Collars 121, 122, and 123 may consist of any number of suitable parts. In general, collars 121, 122, and 123 are meant to hold an axial position relative to tubular 100, standard buoyancy modules 101A, 101B, 101C, or grooved buoyancy module 102 so as to restrict the axial movement of an adjacent VIV suppression device.

Still referring to FIG. 1B, collars 121, 122, and 123 may be made of any suitable material including, but not limited to, plastic, fiberglass, metal, ceramic, wood, and composite.

Figure 1C:
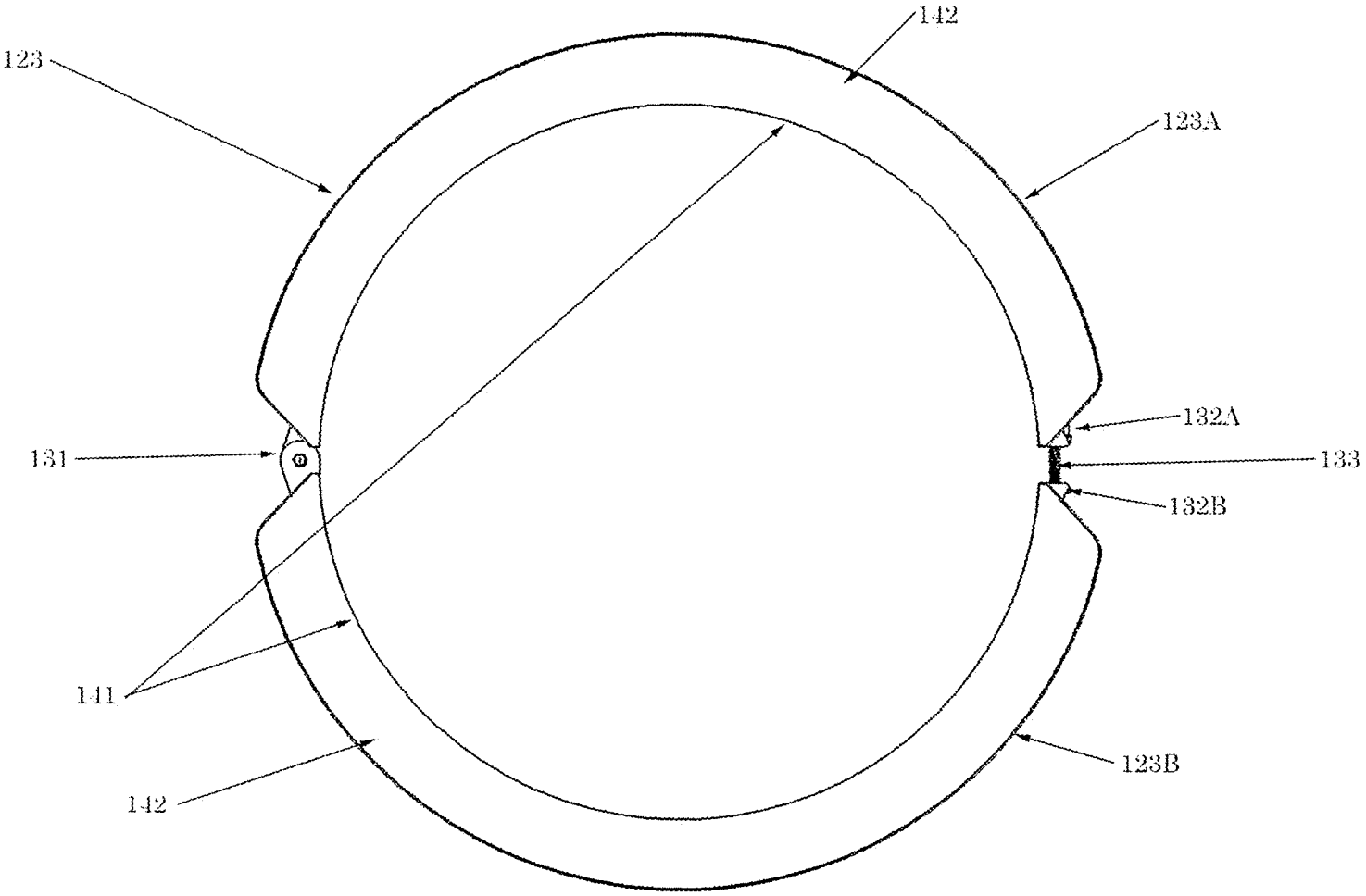
FIG. 1C is a top view of a collar.

Referring now to FIG. 1C, collar 123 is shown having halves 123A and 123B which are connected by hinge 131 at one end and bolt 133, which joins brackets 132A and 132B, at the other end. Collar 123 may have a web 141, which is a band like portion that is positioned around tubular 100, and flanges 142, which extend outwardly from the web 141 (and the tubular), on both halves.

Again referring to FIG. 1C, web 141 is adjacent to, or against, the underlying tubular. Flanges 142 extend outwardly from each edge of web 141 and are adjacent the top or bottom end of the VIV suppression device (positioned above or below the collar 123). If web 141 is clamped tight against an underlying tubular or buoyancy module, or if web 141 is in a groove of a buoyancy module, then collar 123 can resist axial movements (movements along the longitudinal axis of the underlying tubular) of adjacent VIV suppression devices such as helical strakes and fairings. Bolt 133 represents one possible method of tightening collar 123 against an underlying tubular. However, other fastening methods such as bands may be used. Hinge 131 is optional in that it may be replaced by a bolt or other attachment method or completely omitted if the collar halves 123A and 123B are banded to an underlying tubular or buoyancy module. Collar halves 123A and 123B may be joined by any suitable means. Collar 123 may consist of two halves or may consist of a single piece (e.g. a piece that is sufficiently flexible to be installed around the underlying tubular or buoyancy module; alternatively it may be somewhat stiff and may be slid over the end of the underlying tubular or buoyancy module). Collar 123 can consist of any number of sections around the circumference and collar 123 can cover only part of the circumference of the underlying tubular or buoyancy module or cover all of the circumference of the underlying tubular. Collar 123 may be of any suitable cross section including, but not limited to, "L-shaped", "C-shaped", square or rectangular, circular or elliptical, and "I-shaped". Collar 123 may be made of multiple components. For example, brackets 132A and 132 as well as hinge 131 may be attached to one or more bands that travel around the circumference of the underlying tubular or buoyancy module. In general collar 123, and any of its components, may be of any suitable shape or geometry. Its primary function is to protrude from the underlying tubular or buoyancy module to above or below an adjacent VIV suppression device and therefore provide a resistance to the adjacent VIV suppression device against axial movement along the underlying tubular.

Still referring to FIG. 1C, any number of hinges 131, bolts 133, brackets 132A, and 132B may be present. Springs may also be present on the collar or attachment mechanisms in order to accommodate diameter changes of the underlying tubular due to hydrostatic pressure. Collar 123, including halves 123A and 123B, hinge 131, bolt 133, and brackets 132A and 132B may be of any suitable material including, but not limited to, metal, plastic, fiberglass, wood, and composite. Each of these parts may be made of the same material or different materials and the materials may be mixed and matched in any suitable manner.

Figure 1D:
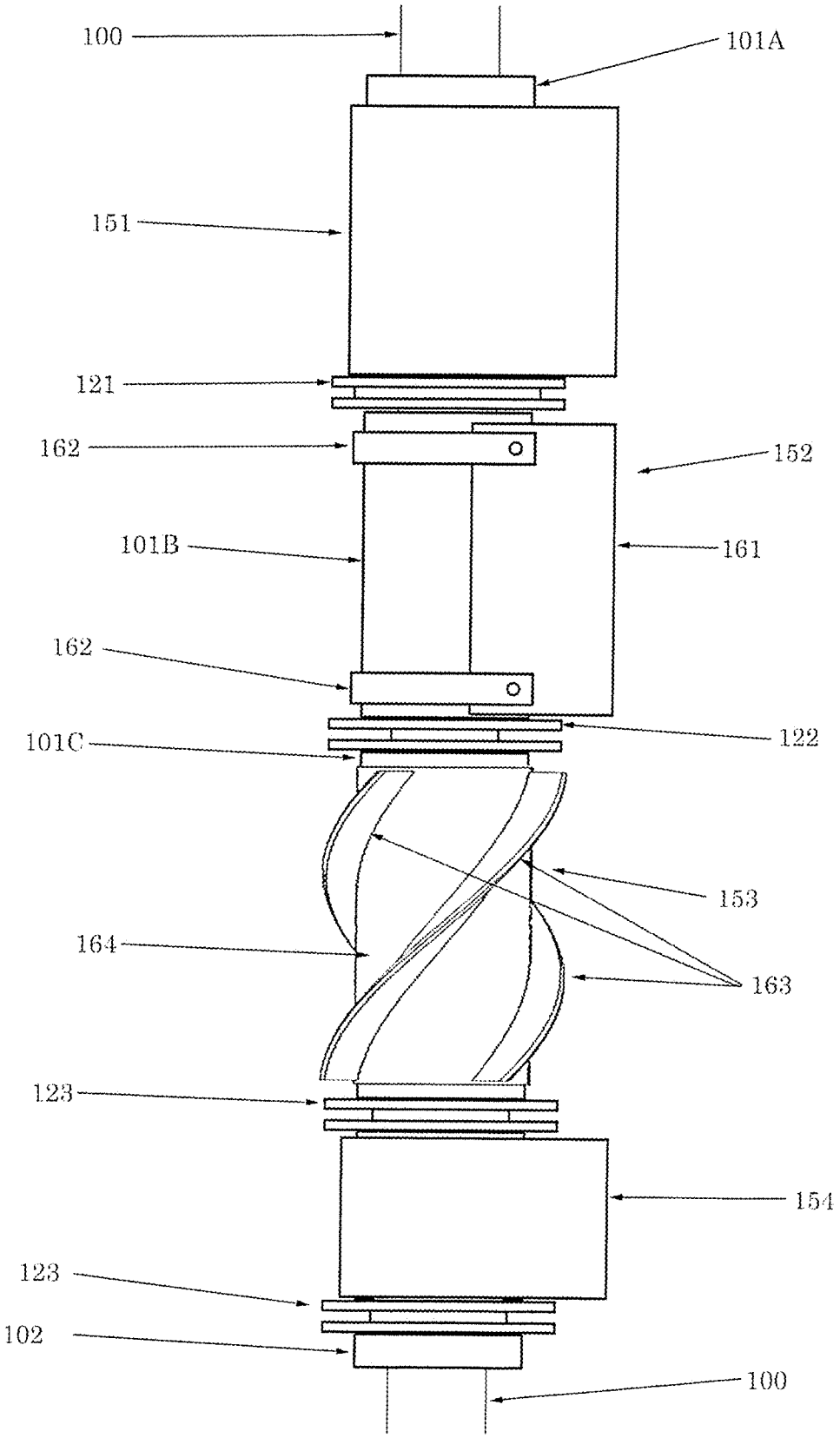
FIG. 1D is a side view of a tubular with buoyancy modules, collars, and sample VIV suppression devices.

Referring now to FIG. 1D, this figure shows buoyancy modules 101A, 101B, 101C, and grooved buoyancy module 102 on tubular 100. Collar 121 is on buoyancy module 101A, collar 122 is in the gap below buoyancy module 101B, and collars 123 are in grooves on grooved buoyancy module 102. A full fairing 151 may be positioned on buoyancy module 101A, a tail fairing 152 may be positioned on buoyancy module 101B, a helical strake 153 may be positioned on buoyancy module 101C, and a full fairing 154 may be positioned on grooved buoyancy module 102. Tail fairing 152 may include a tail 161 and straps 162 that at least partially encircle the buoyancy module 101B, and connect the tail 161 to the buoyancy module 101B and tubular 100. Full fairings 151 and 154 may include a body having a nose portion that at least partially encircles the buoyancy module 101A and a tail portion (e.g., a triangular portion) that extends outwardly from buoyancy module 101A. Helical strake 153 may include a shell 164 that at least partially encircles the buoyancy module 101C and fins 163 that wrap helically around the shell 164.

Again referring to FIG. 1D, this figure illustrates how various VIV suppression devices may be present on a buoyancy module. Full fairings 151 and 154 may be free to rotate around the underlying buoyancy modules but may be restricted from axial movement by the adjacent collars. Similarly, tail fairing 152 may be free to rotate around buoyancy module 101B (straps 162 are loose around buoyancy module 101B and thus have a small gap between the straps and buoyancy module 101B) and restrained axially by collars 121 and 122. Helical strake 153, while usually tight against an underlying tubular or buoyancy module 101C, may be relatively loose (i.e. free to rotate) when adjacent collars are present.

Still referring to FIG. 1D, from FIG. 1D it can be seen that grooved buoyancy module 102 allows for collars 123 to restrain axial movement of full fairing 154 without collars 123 having to be clamped tight against grooved buoyancy module 102. Similarly, collar 122, which utilizes the effective "groove" or gap between adjacent buoyancy modules 101A and 101B, may restrain axial movement of the adjacent VIV suppression devices (tail fairing 152 and helical strake 153) without needing to be clamped tight against an underlying buoyancy module or tubular 100.

Still referring to FIG. 1D, it is important to note that, while collars 121, 122, and 123 are all shown external to the various VIV suppression devices (full fairings 151 and 154, tail fairing 152, and helical strake 153), it is also possible for the collars to be internal to the suppression devices and restrict their axial movement by resisting an internal shoulder or other appurtenance inside of the VIV suppression devices. It is also important to note that each of the VIV suppression devices (full fairings 151 and 154, tail fairing 152, and helical strake 153) and collars 121, 122, and 123 may be of any suitable geometry or material.

Figure 1E:
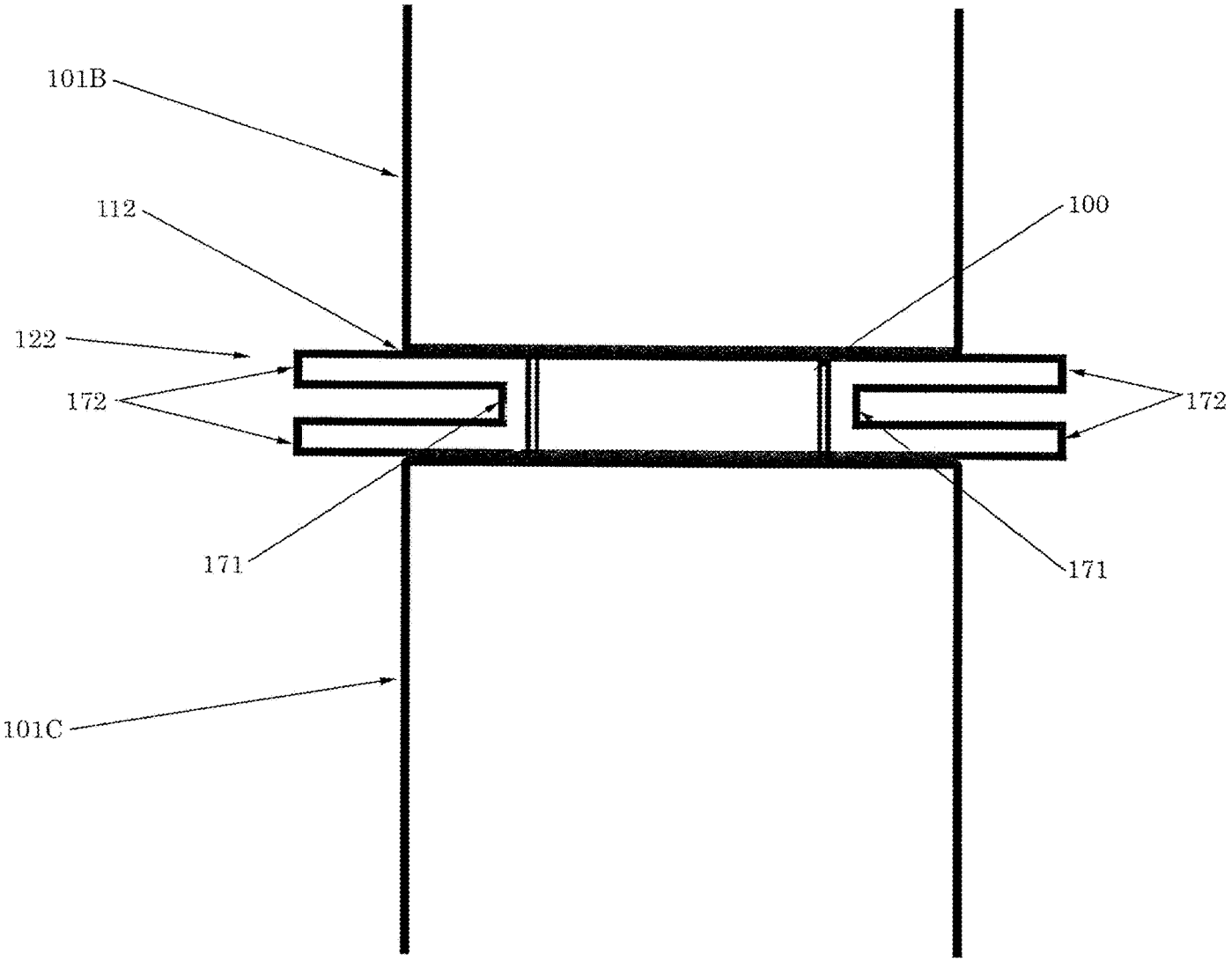
FIG. 1E is a cross sectional view of a collar installed against an inner tubular and between adjacent buoyancy modules.

Referring now to FIG. 1E, buoyancy modules 101B and 101C are shown on tubular 100 and are separated by gap 112. Collar 122 is present in gap 112. In this embodiment, collar 122 is made up of web 171 and flanges 172. Web 171 may be a cylindrical member that at least partially encircles tubular 100. Flanges 172 may extend from opposing edges of web 171 (e.g., edges facing a direction of module 101B and 101C) in a direction radially outward to tubular 100. As can be seen from FIG. 1E, flanges 172 are spaced a part a distance by the web 171, such that, for example, an annularly shaped channel is formed around the tubular 100. In some cases, web 171 and portions of flanges 172 may be positioned within gap 112 such that the bottom side of the top buoyancy module 101B rests on the top side of the upper most flange 172, and the top side of the bottom buoyancy module 101C contacts the bottom side of the lower most flange 172.

Again referring to FIG. 1E, collar 122 may be clamped tight against tubular 100 or may be simply closed around tubular 100 since buoyancy modules 101B and 101C provide resistance to axial movement. Any number of flanges 172 may be present on collar 122, for example collar 122 may have one flange, two flanges, or any number of flanges. Collar 122 may travel around the full circumference of tubular 100 or may travel around just part of the circumference of tubular 100 and may be made of any number of sections that may each be optionally connected to each other by any suitable means.

Figure 1F:
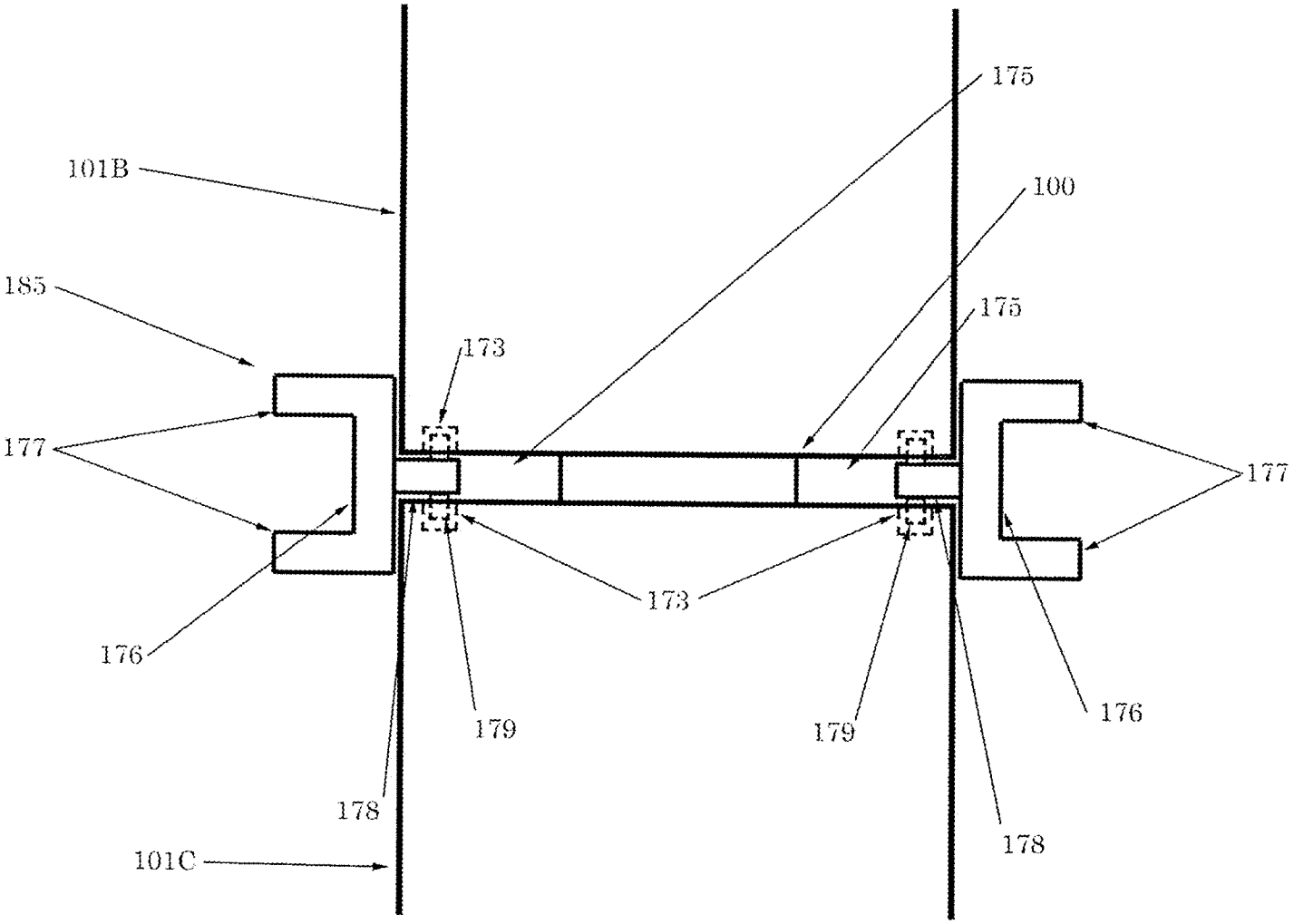
FIG. 1F is a cross sectional view of a collar installed between adjacent buoyancy modules.

Referring now to FIG. 1F, buoyancy modules 101B and 101C are shown on tubular 100 and are separated by gap 175. In this embodiment, collar 185 is positioned in gap 175 similar to collar 122, but is made up of web 176, flanges 177, and a guide 178.

Again referring to FIG. 1F, collar 185 may be clamped tight against tubular 100 (if guide 178 was extended towards tubular 100) or may be simply closed around tubular 100 since buoyancy modules 101B and 101C provide resistance to axial movement. Any number of flanges 177 and guides 178 may be present on collar 185. Collar 185 and guide 178 may travel around the full circumference of tubular 100 or may travel around all or just part of the circumference of tubular 100 and may be made of any number of sections that may each be optionally connected to each other by any suitable means.

Still referring to FIG. 1F, guide 178 is designed fit into gap 175 and thus provide resistance to axial movement of collar 185 of adjacent VIV suppression devices. For example, guide 178 may be a radially oriented member that extends from the surface of web 176 facing tubular, and into the gap 175 formed between buoyancy modules 101B and 101C. Collar 185, guide 178, flanges 177, and web 176 may be made of any suitable material and may be made of the same material (and even molded or formed together) or made of different materials. In addition, in some embodiments, an optional slot 173, illustrated by a perforated line here, may be formed in each of the ends of buoyancy modules 101B and 101C defining gap 175. Slot 173 may be dimensioned to receive an insertion member 179 extending from guide 178. For example, slot 173 could be an axially oriented slot formed inwardly from the end of each of modules 101B and 101C, and insertion member 179 could be an axially oriented protrusion extending from the top side and the bottom side of guide 178 as shown. Insertion member 179 could, in some embodiments, be a resilient member. In this aspect, insertion member 179 retracts so that guide 178 can be inserted into gap 175, and then insertion member 179 expands once it reaches slot 173, locking the guide 178 within gap 175. It should be understood that while, for example, an axially oriented slot 173 and insertion member 179 are shown, they may have any configuration and/or orientation suitable for locking guide 178 within gap 175 as shown.

Figure 1G:
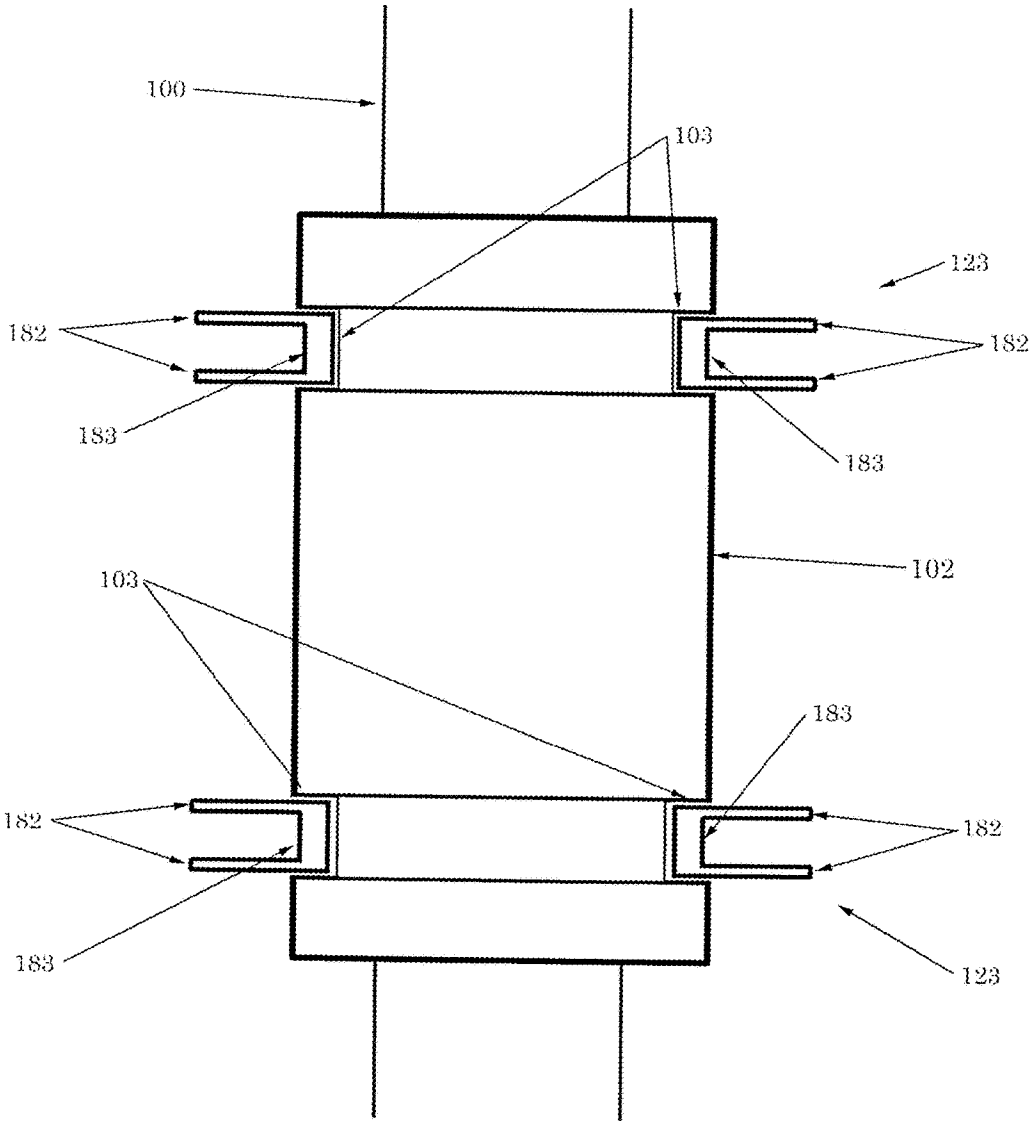
FIG. 1G is a cross sectional view of a collar installed in the grooves of a buoyancy module.
Figure 1H:
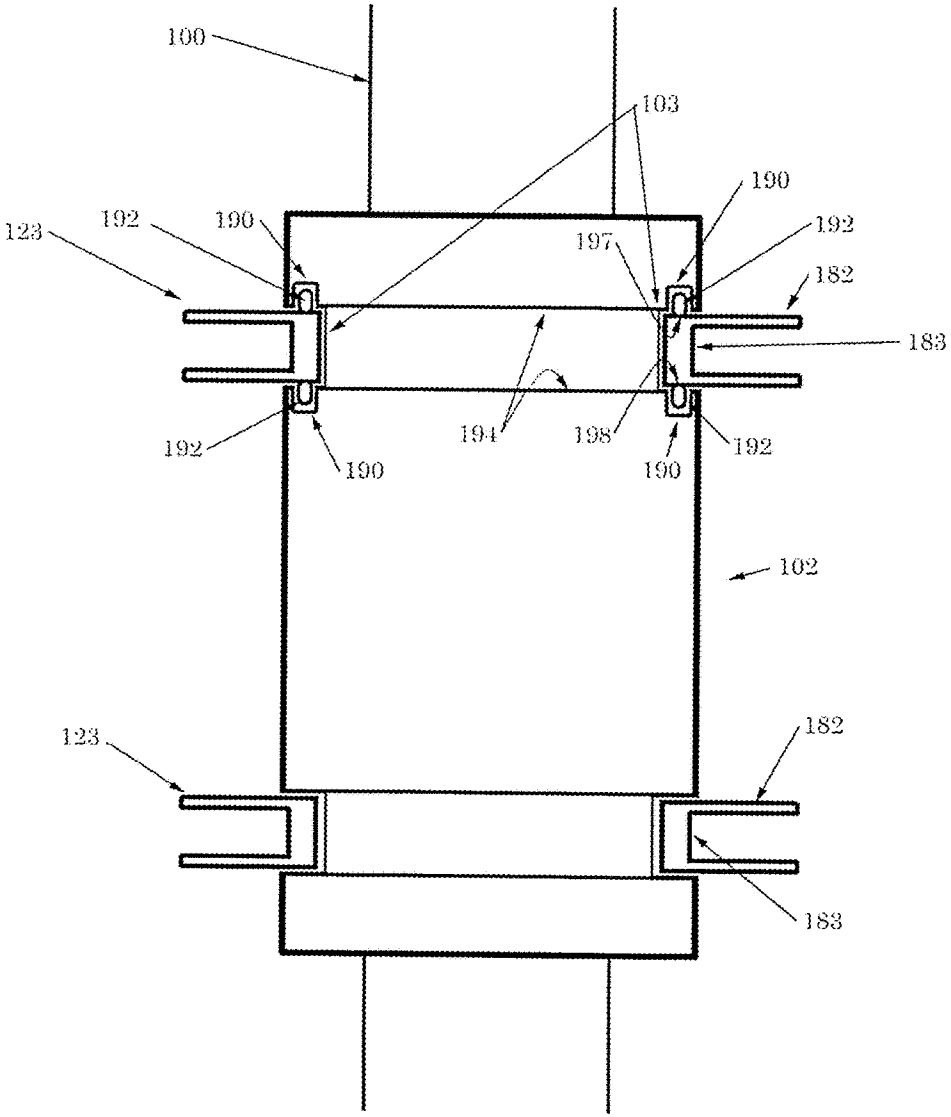
FIG. 1H is a cross sectional view of a collar installed in the grooves of a buoyancy module.

Referring now to FIG. 1G, FIG. 1G illustrates a grooved buoyancy module 102 on tubular 100. Grooved buoyancy module 102 has grooves 103 (e.g., formed inwardly from the outer collar surface) and with a collar 123 positioned in each groove. Collars 123 are made up of webs 183 and flanges 182, as previously discussed.

Again referring to FIG. 1G, collar 123 may be clamped tight against grooved buoyancy module 102 or may be simply closed around grooved buoyancy module 102 since the grooves provide resistance to axial movement. Any number of flanges 182 may be present on collar 123 and collar 123 and its components may travel around all or just part of grooved buoyancy module 102. Collar 123 may be made of any suitable material.

Referring now to FIG. 111, FIG. 111 illustrates another embodiment of grooved buoyancy module 102 on tubular 100. In this embodiment, the additional features of a slot 190 and engaging or insertion member 192 for fastening the collar 123 within groove 103 are disclosed. In particular, groove 103 may include a slot 190 formed inwardly from each of the sidewalls 194 of groove 103. In other words, slot 190 is an axially oriented slot, which opens in a direction perpendicular to the direction in which groove 103 opens. It should further be understood, that slot 190 may be formed anywhere along the exterior surface of module 102, and need not be formed within the groove 103. Collar 123 may, in turn, include an insertion member 192 dimensioned to be inserted within slot 190. In this aspect, insertion member 192 could be a structure which extends outwardly from a top side 197 and a bottom side 198 of web 183 of collar 123. In other words, similar to slot 190, insertion member 192 is an axially oriented structure. For example, in one aspect, insertion member 192 could be a spring or other resilient structure which will compress as the collar 123 is being inserted into the opening of groove 103, and then expand once it reaches slot 190, such that insertion member 192 engages with, and remains within, slot 190. This, in turn, helps to hold or otherwise restrain collar 123 within groove 103. In addition, it should be recognized that since, in this embodiment the collar 123 is essentially self-restrained against buoyancy module 102, collar 123 could be made up of two or more segments, which are not necessary connected to one another. Rather, each collar segment may be positioned separately around the circumference of buoyancy module 102, and each segment can restrain itself by inserting the insertion member 192 extending from the web of that segment into 190 of groove 103. In addition, it should be recognized that while a slot 190 and insertion member 192 are only illustrated on one of the grooves 103 and collars 123 of FIG. 111 (e.g., the top groove and collar), these features could also be included in the bottom groove 103 and collar 123, or any number of grooves/collars associated with a buoyancy module. In addition, it should be recognized that slots 190 and insertion members 192 may be oriented in other directions, and slot 190 need not be associated with groove 103. Representatively, slot 190 and/or insertion members 192 may be oriented in any direction, or in multiple directions, suitable for engaging with one another. For example, in some embodiments, slot 190 could be formed inwardly from the exterior surface of module 102 (separate from groove 103), and have a geometry suitable for engaging with a geometry of insertion member 192 (e.g., a "Y" or "T" shaped). In other cases, slot 190 and/or insertion members 192 may be oriented radially, and in such cases, have secondary slots that are not oriented radially.

Figure 1I:
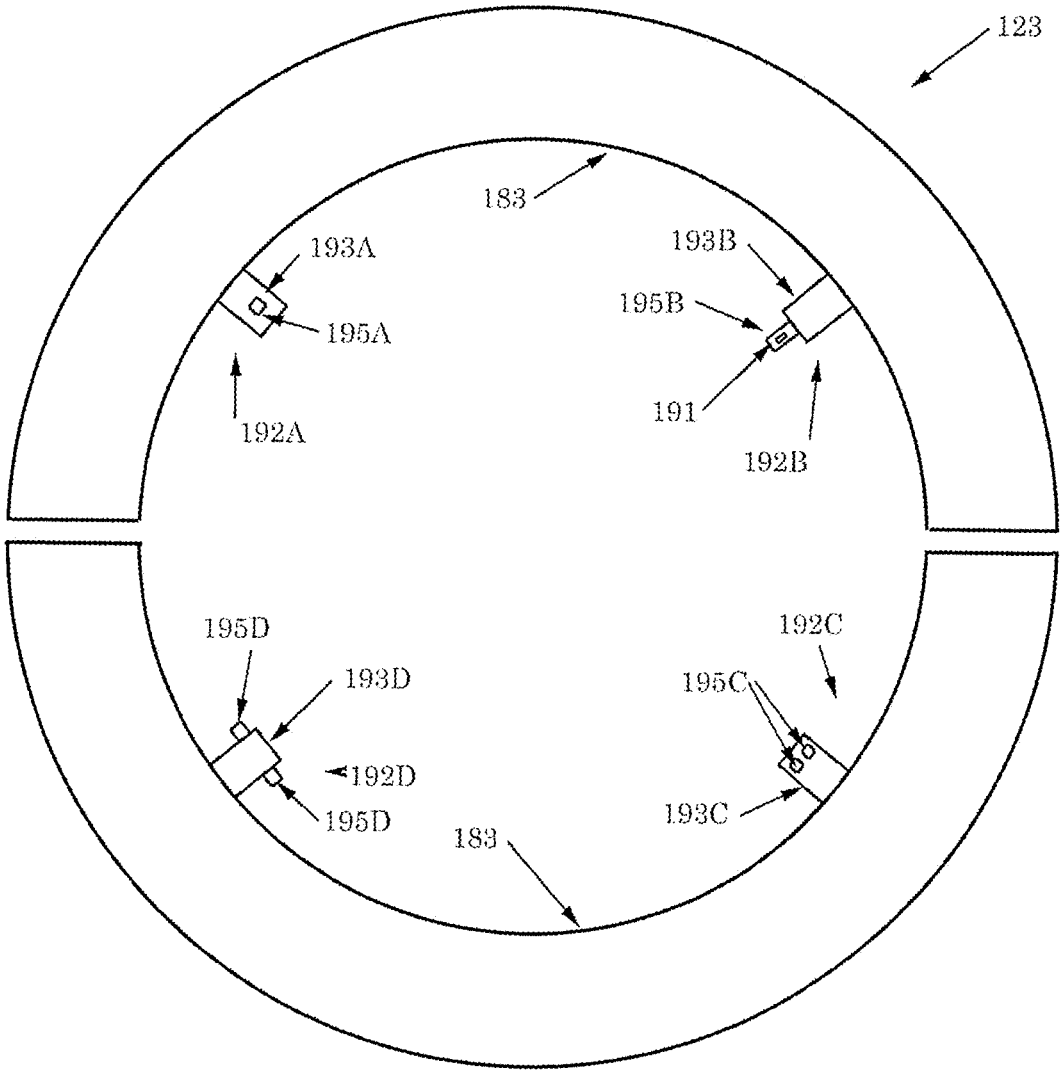
FIG. 1I is a top view of a collar having engaging members.
Figure 1J:
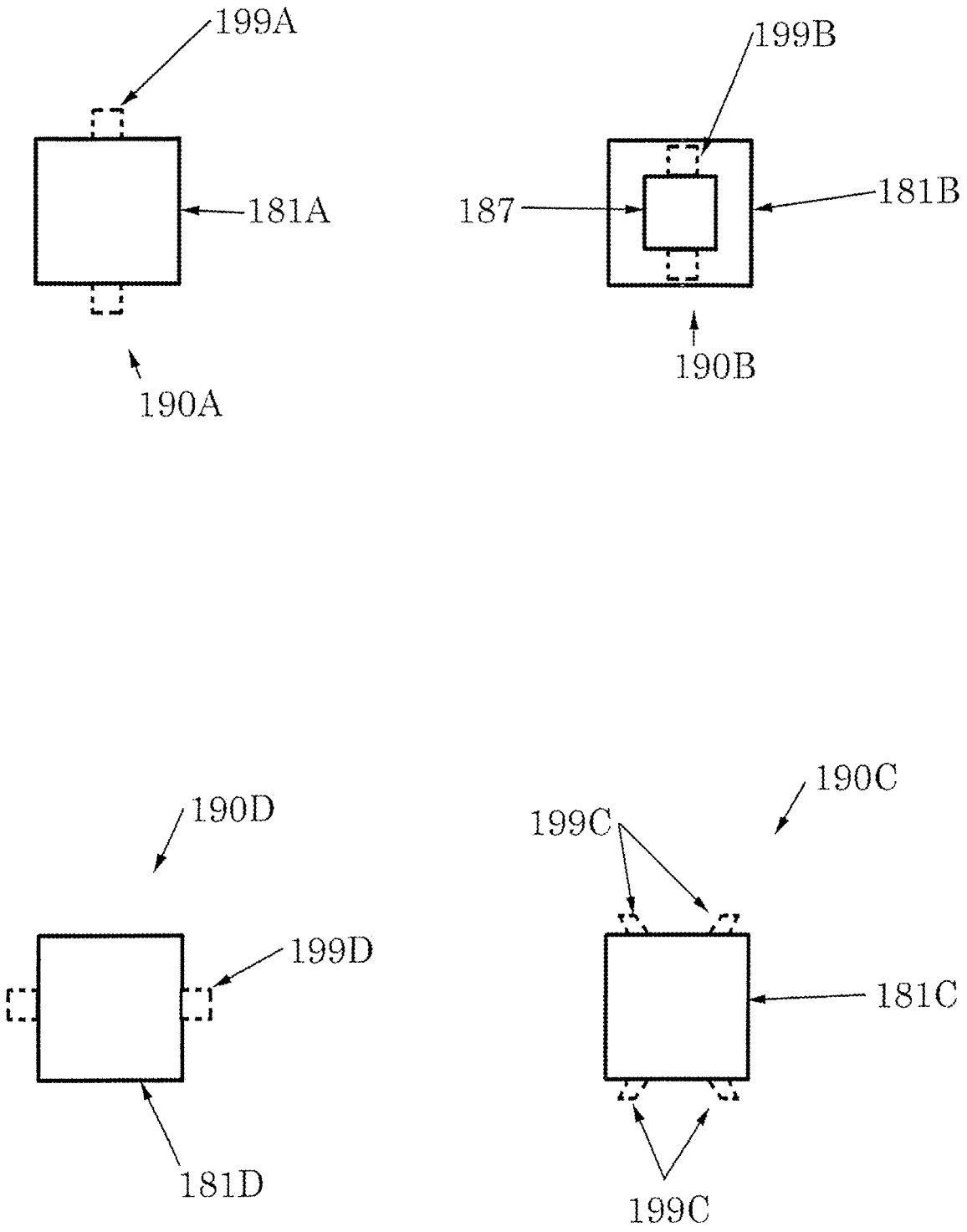
FIG. 1J is a front view dimensioned to receive the engaging members of FIG. 1I.

Representatively, FIG. 1I illustrates a top view of a collar having engaging or insertion members with different geometries, and FIG. 1J illustrates a front view of the various slots having different geometries for receiving the different engaging or insertion members. For example, FIG. 1I shows insertion members 192A, 192B, 192C and 192D, each having different geometries. It should be understood that although the different insertions members 192A-192D are shown on one collar 123 (or the collar sections), all of the insertion members on a single collar may have a same geometry (e.g., a collar may have four insertion members of the same geometry). Therefore, FIG. 1I is intended to illustrate the different geometries an insertion member can have, but they would not necessarily all be on the same collar.

Referring now to insertion member 192A, insertion member 192A includes a first portion 193A which extends in a first direction from collar 123 (e.g., from the web 183 of collar 123), for example a radially inward direction, and a second portion 195A which extends perpendicular to the first portion 193A, for example in an axial direction. In some cases, the second portion 195A may be a retractable or resilient portion, for example, a spring or the like, which retracts when insertion member 192A is being inserted into a slot, and then expands once it is properly positioned with respect to a second member receiving portion of the slot. The overall shape of insertion member 192A could be considered, for example, a "T" shape. For example, FIG. 1J shows a front view of a slot 190A dimensioned to receive insertion member 192A. From this view, it can be seen that slot 190A includes a primary opening 181A, which is large enough to receive first portion 193A and second portion 195A, and then a secondary opening 199A which is dimensioned to receive only second portion 195A. In this aspect, the openings 181A, 199A may have different orientations, or open in different directions, that are suitable for receiving the different portions 193A, 195A. For example, primary opening 181A may open in a radial direction, or be considered an opening to a radially extending portion of the slot 190A, and secondary opening 199A may open in an axial direction, and be considered an opening to an axially extending portion of slot 190A. In this aspect, when insertion member 192A is inserted into slot 190A, first portion 193A engages with the primary opening 181A (or slot, or channel portion) and second portion 195A expands once it reaches the secondary opening 199A, and engages with the secondary opening 199A (or slot, or channel), to hold insertion member 192A within slot 190A.

Referring now to insertion member 192B, insertion member 192B includes a first portion 193B which extends in a first direction from collar 123 (e.g., from the web 183 of collar 123), for example a radially inward direction, a second portion 195B which extends in a same direction as the first portion 193B, for example in an radial direction, and a third portion 191 which extends in a direction perpendicular to the first and second portions 193B, 195B, for example, an axial direction. In some cases, the third portion 191 may be a retractable or resilient portion, for example, a spring or the like, which retracts when insertion member 192B is being inserted into a slot, and then expands once it is properly positioned with respect to a second member receiving portion of the slot. The overall shape of insertion member 192B could be considered, for example, a "T" shape. For example, FIG. 1J shows a front view of a slot 190B dimensioned to receive insertion member 192B. From this view, it can be seen that slot 190B includes a primary opening 181B, which is large enough to receive first portion 193B, second portion 195B, and third portion 191, a secondary opening 187 which is dimensioned to receive only second portion 195B and third portion 191, and then a tertiary opening 199B that extends perpendicular to openings 181B and 187, and is dimensioned to only receive third portion 191. In this aspect, each of openings 181B, 187 and 199B may have different sizes. In addition, openings 181B and 187 may have different orientations, or open in different directions, than opening 199B. For example, primary opening 181B and secondary opening 187 may open in a radial direction, or be considered an opening to a radially extending portion of the slot 190B, and tertiary opening 199B may open in an axial direction, and be considered an opening to an axially extending portion of slot 190B. In this aspect, when insertion member 192B is inserted into slot 190B, first portion 193B engages with the primary opening 181B (or slot, or channel portion), second portion 195B engages with secondary opening 187 and third portion 191 expands once it reaches the tertiary opening 199B, and engages with opening 199B (or slot, or channel), to hold insertion member 192B within slot 190B.

Referring now to insertion member 192C, insertion member 192C includes a first portion 193C which extends in a first direction from collar 123 (e.g., from the web 183 of collar 123), for example a radially inward direction, and a second portion 195C which extends in a different direction to first portion 193C, for example at an angle to first portion 193C. In some cases, the second portion 195C may be a retractable or resilient portion, for example, a spring or the like, which retracts when insertion member 192C is being inserted into a slot, and then expands once it is properly positioned with respect to a second member receiving portion of the slot. The overall shape of insertion member 192C could be considered, for example, a "V" or "X" shape. For example, FIG. 1J shows a front view of a slot 190C dimensioned to receive insertion member 192C. From this view, it can be seen that slot 190C includes a primary opening 181C, which is large enough to receive first portion 193C and second portion 195C, and then a secondary opening 199*c* which is dimensioned to receive only second portion 195*c*. In this aspect, the openings 181C, 199C may have different orientations, or open in different directions, that are suitable for receiving the different portions 193C, 195C. For example, primary opening 181C may open in a radial direction, or be considered an opening to a radially extending portion of the slot 190C, and secondary opening 199C may open at an angle to that of opening 181C, for example an angle between zero and ninety degrees, and be considered an opening to an angled portion of slot 190C. In this aspect, when insertion member 192C is inserted into slot 190C, first portion 193C engages with the primary opening 181C (or slot, or channel portion) and second portion 195C expands once it reaches the secondary opening 199C, and engages with the secondary opening 199C (or slot, or channel), to hold insertion member 192C within slot 190C.

Referring now to insertion member 192D, insertion member 192D includes a first portion 193D which extends in a first direction from collar 123 (e.g., from the web 183 of collar 123), for example a radially inward direction, and a second portion 195D which extends perpendicular to the first portion 193D, for example in a horizontal direction. In some cases, the second portion 195D may be a retractable or resilient portion, for example, a spring or the like, which retracts when insertion member 192D is being inserted into a slot, and then expands once it is properly positioned with respect to a second member receiving portion of the slot. The overall shape of insertion member 192D could be considered, for example, a "T" shape. For example, FIG. 1J shows a front view of a slot 190D dimensioned to receive insertion member 192D. From this view, it can be seen that slot 190D includes a primary opening 181D, which is large enough to receive first portion 193D and second portion 195D, and then a secondary opening 199D which is dimensioned to receive only second portion 195D. In this aspect, the openings 181D, 199D may have different orientations, or open in different directions, that are suitable for receiving the different portions 193D, 195D. For example, primary opening 181D may open in a radial direction, or be considered an opening to a radially extending portion of the slot 190D, and secondary opening 199D may open in a different direction. In this aspect, when insertion member 192D is inserted into slot 190D, first portion 193D engages with the primary opening 181D (or slot, or channel portion) and second portion 195D expands once it reaches the secondary opening 199D, and engages with the secondary opening 199D (or slot, or channel), to hold insertion member 192D within slot 190D.

Figure 2:
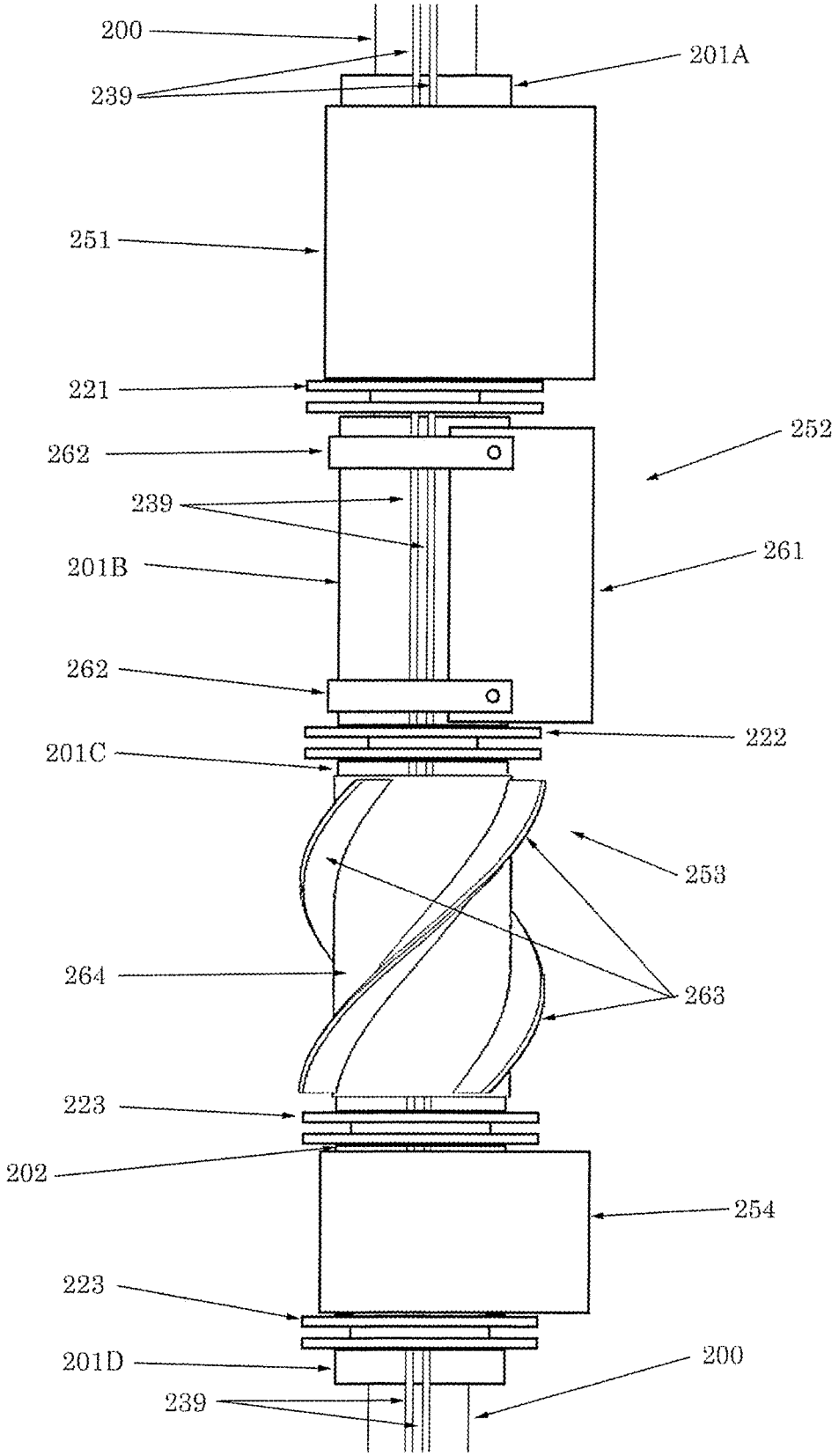
FIG. 2 is a side view of a tubular with buoyancy modules, collars, external lines, and sample VIV suppression devices.

Referring now to FIG. 2, FIG. 2 illustrates buoyancy modules 201A, 201B, 201C, and grooved buoyancy module 202 on tubular 100. Collar 221 is on buoyancy module 201A, collar 222 is in the gap below buoyancy module 201B, and collars 223 are in grooves on grooved buoyancy module 202. Full fairing 251 may be on buoyancy module 201A, tail fairing 252 may be on buoyancy module 201B, helical strake 253 may be on buoyancy module 201C, and full fairing 254 may be on grooved buoyancy module 202. Tail fairing 252 may include a tail 261 and straps 262, as previously discussed. Helical strake 253 may include a shell 264 and fins 263, as previously discussed. In addition, in this embodiment, auxiliary lines 239 are shown traveling along the outside of buoyancy modules 201A, 201B, 201C, and grooved buoyancy module 202, and under the VIV suppression devices (full fairings 251 and 254, tail fairing 252, and helical strake 253).

In this aspect, FIG. 2 is similar to FIG. 1D except for the presence of auxiliary lines 239. These lines may be control lines, mux lines, chock and kill lines, etc. and are optional. Auxiliary lines 239 may travel over or under collars 221, 222, and 223 and may also be set into one or more longitudinal grooves or openings in standard buoyancy modules 201A, 201B, 201C, or grooved buoyancy module 202. Various appurtenances may be used in conjunction with auxiliary lines 239 to hold them in place or to make them easier to install. Such appurtenances may be on standard buoyancy modules 201A, 201B, 201C, and grooved buoyancy module 202 or on collars 221, 222, and 223.

Still referring to FIG. 2, any number of auxiliary lines 239 may be present and they may be of any suitable size or diameter. Auxiliary lines 239 may be treated together or separately in terms of their handling within the present invention.

Figure 3A:
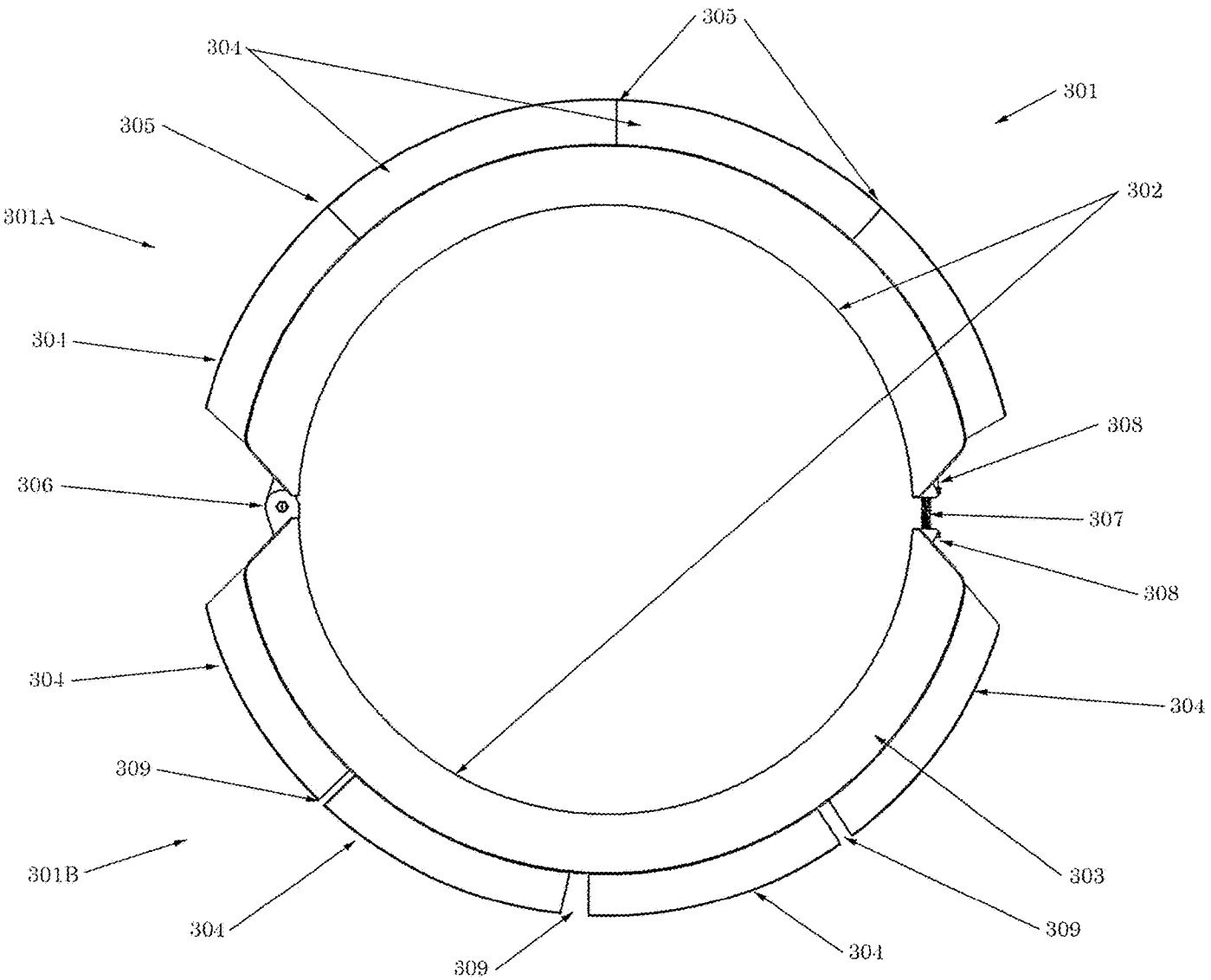
FIG. 3A is a top view of a collar with inner and outer flanges.

Referring now to FIG. 3A, FIG. 3A illustrates collar 301 including two halves 301A and 301B which each have a web 302 (which encircles the tubular) and inner flanges 303 (which extend radially outward from the top and bottom edges of web 302). Collar 301 may further include outer flanges 304, which are formed radially outward to inner flanges 303. In some embodiments, any number of small flange gaps 305 and large flange gaps 309 may be formed within outer flanges 304. Collar halves 301A and 301B may be attached by hinge 306 on one side and bolt 307 on the other side. Bolt 307 may utilize brackets 308, which are attached to the interfacing ends of collar halves 301A and 301B, to connect and optionally tighten collar 301 around an underlying tubular.

Again referring to FIG. 3A, collar 301 may be positioned in a buoyancy module groove and, by allowing the outer flanges 304 to fold or retract, collar 301 may be permanently mounted into a buoyancy module without protruding outside the buoyancy module and potentially getting damaged. When desired, such as when a VIV suppression device is to be supported by the collar 301, outer flanges 304 can be unfolded or extended, thus extending an overall length of the flanges beyond the outer surface of module 320. Once extended, the outer flanges 304 can then be used to support the VIV suppression device. Any number of outer flanges 304 may be present and adjacent outer flanges may be separated by small gaps such as small flange gaps 305 or by larger gaps such as large flange gaps 309 (i.e. the gaps between adjacent flanges may be of any suitable size or shape). Outer flanges 304 may be of any suitable size or shape and may be attached to collar 301 or to inner flange 303 by any suitable means. Outer flanges 304 may extend around all or part of the circumference of collar 301 or that of an underlying tubular.

Still referring to FIG. 3A, web 302, inner flange 303, outer flanges 304, hinge 306, bolt 307, and brackets 308 may be made of any suitable material. As noted previously collar 301 may be made of any number of components (one piece, halves, thirds, etc.) and any suitable means may be used to attach adjacent collar sections.

Figure 3B:
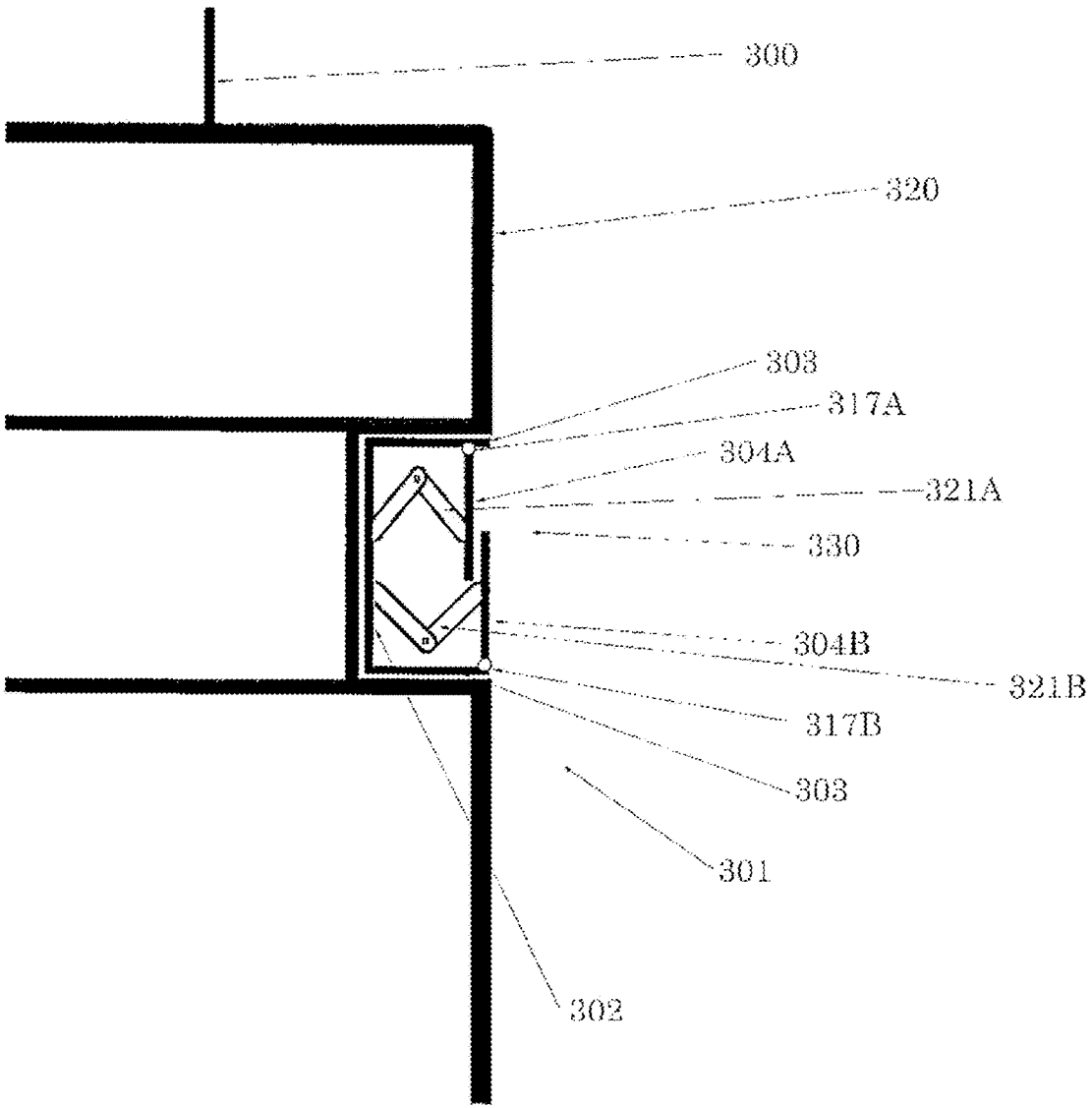
FIG. 3B is a section view of a collar in a groove with inner and outer flanges in a closed position.
Figure 3C:
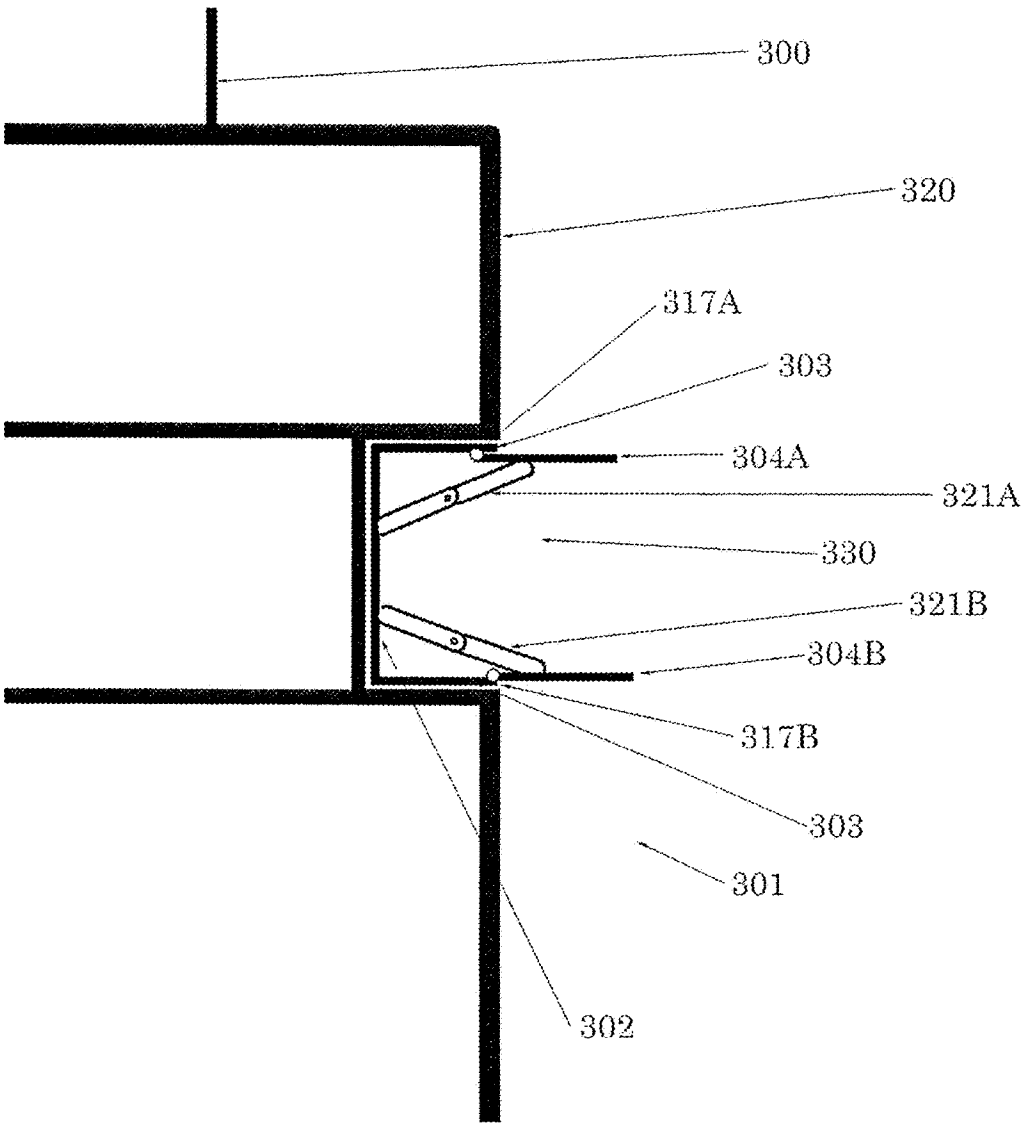
FIG. 3C is a section view of a collar in a groove with inner and outer flanges in an open position.

Referring now to FIG. 3B and FIG. 3C, FIG. 3B and FIG. 3C show a section view of grooved buoyancy module 320, containing groove 330, and collar 301, attached to tubular 300. Collar 301 may have web 302, inner flanges 303, and outer flanges 304A and 304B. Outer flange 304A may be connected to web 302 by bracket 321A while outer flange 304B may be connected to web 302 by bracket 321B. Outer flange 304A may be attached to the upper most inner flange 303 by hinge 317A while outer flange 304B may be attached to the lower most inner flange 303 by bracket 321B.

Again referring to FIG. 3B and FIG. 3C, outer flanges 304A and 304B can be retracted as shown in FIG. 3B or can be extended by opening brackets 304A and 304B as shown in FIG. 3C. FIG. 3C is identical to FIG. 3B but shows outer flanges 304A and 304B in the open position.

Still referring to FIG. 3B and FIG. 3C, while this figure shows outer flanges 304A and 304B that open up to be both on the top and bottom of collar 301, any number of outer flanges 304A and 304B may be present. For example, a single outer flange could be present, two outer flanges could be present (such as shown in FIG. 3B and FIG. 3C) or three or more outer flanges could be present. Outer flanges 304A and 304B may be extended by any suitable means and other appurtenances to support the retraction, storage, or extension of outer flanges 304A and 304B may be present (in place of, or in conjunction with, brackets 321A and 321B). Outer flanges 304A and 304B may rotate as shown in FIG. 3B and FIG. 3C or may simply slide out of groove 330. Grooved buoyancy module 320 may optionally have other appurtenances or features to support, or facilitate, flanges that extend or retract.

Still referring to FIG. 3B and FIG. 3C, any number of brackets 321A and 321B and hinges 317A and 317B may be present and they may be made of any suitable material.

Figure 4A:
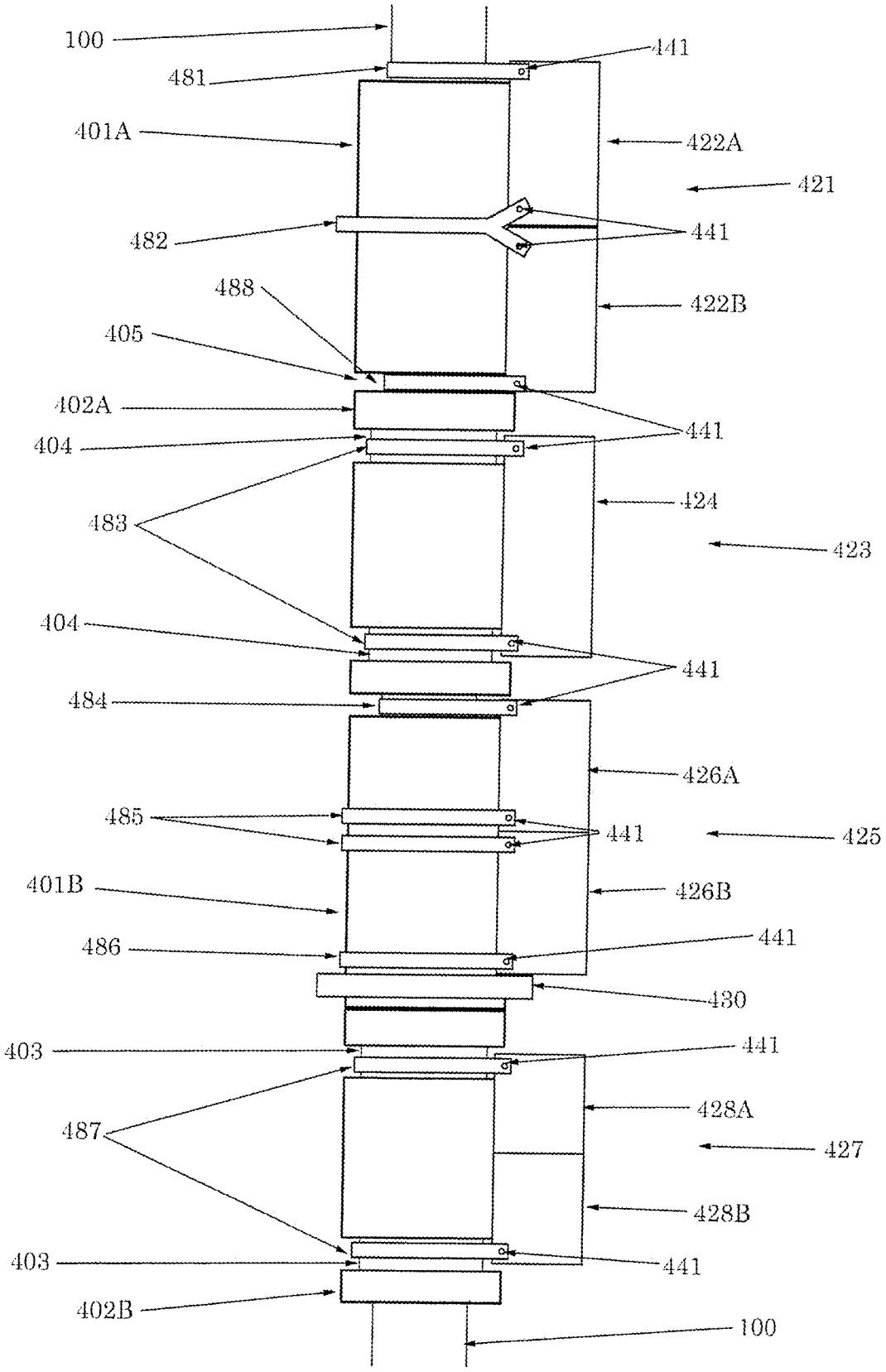
FIG. 4A is a side view of a tubular with alternative buoyancy modules and various arrangements of tail fairings.

Referring now to FIG. 4A, FIG. 4A shows tubular 100 fitted with buoyancy modules 401A and 401B, and grooved buoyancy modules 402A and 402B. Grooved buoyancy module 402A has grooves 404 while grooved buoyancy module 402B has grooves 403. In this embodiment, fairing 421 may include fairing tails 422A and 422B and straps 481 and 488 as well as double strap 482, which keep fairing 421 adjacent to buoyancy module 401A. Fairing 423 may include fairing tail 424 and straps 483, which are in grooves 404, which keep fairing 423 adjacent to buoyancy module 402A. Fairing 425 may include fairing tails 426A and 426B and straps 484, 485, and 486 which keep fairing 425 adjacent to buoyancy module 401B. Collar 430 can also be used to support fairing 425. Fairing 427 may include fairing tails 428A and 428B and straps 487 which keep fairing 427 in place adjacent to buoyancy module 402B. All straps are connected to their respective tails by connection ends 441.

Again referring to FIG. 4A, in the case of fairing 421, fairing 421 may include two fairing tails 422A and 422B that are mated to each other (by any suitable means). Fairing 421 also includes straps 481 and 488 which are placed in gaps at the ends of buoyancy module 401A and double strap 482 which is placed around buoyancy module 401A. Fairing 421 is restricted from sliding axially along buoyancy module 401A by strap 488 which can only slide up or down as far as the gap between buoyancy module 401A and 402A will allow. Buoyancy module 402A thus supports the weight of fairing 421. The inside diameter of straps 481 and 488 may be larger than the outside diameter of tubular 100 and the inside diameter of double strap 482 may be larger than the outside diameter of buoyancy module 401A and thus fairing 421 is free to rotate around buoyancy module 401A. Double strap 482 may include a single strap that has two ends with one end attached to tail 422A and one end attached to tail 422B. Tails 422A and 422B are shown as approximately equal in size but may be unequal in size and may be of any suitable length along the span of tubular 100. Tails 422A and 422B may be rigidly or flexibly connected to each other by other means but this is entirely optional since double strap 482 keeps them in place relative to each other so that tail 422A does not put too much weight on a strap below it should it rotate off of tail 422B. Any number of straps 481, 488 and double strap 482 may be used but each strap is optional and only one strap is minimally required to hold fairing 421 in place adjacent to buoyancy module 401A. Straps 481, 488, and double strap 482 may be of any suitable size, shape, or geometry and may be attached to fairing tails 422A and 422B by any suitable means. Fairing tails 422A and 422B may both be present, only one tail may be present, or any number of tails may be present as part of fairing 421. Fairing tails 422A and 422B may be attached to each other in either a rigid or a flexible fashion. Full fairings (fairings that have shrouds that cover the underlying buoyancy modules in place of, or in addition to, straps) may be present in place of fairing 421 and adjacent full fairings may, or may not, be attached to each other.

Still referring to FIG. 4A, in the case of fairing 423, fairing 423 may be a single fairing tail 424 having straps 483. Since straps 483 are in grooves 404, these grooves restrict the ability of fairing 423 to slide along buoyancy module 402A and thus buoyancy module 402A supports the weight of fairing 423. Straps 483 have an inner diameter that is larger than inside diameter of the grooves and thus fairing 423 is free to rotate around buoyancy module 402A. Fairing 423 may have any number of straps 483 present and buoyancy module 402A may have any number of grooves 404 present. Instead of housing straps 483, one or more grooves 404 may instead house a collar, which clamps tight around buoyancy module 402A, and which supports the weight of fairing 423.

Still referring to FIG. 4A, in the case of fairing 425, fairing 425 may have strap 484 which resides above buoyancy module 401B, and straps 485 and 486 which reside around buoyancy module 401B. The weight of fairing 484 may be supported by strap 484 or by collar 430, depending upon the geometrical arrangement of the strap 484 and tails 426A and 426B. Tails 426A and 426B are rigidly or flexibly locked relative to each other so that, if the tails rotate so that they are not vertically aligned such that they support each other's weight or buoyancy, tails 426A and 426B do not put too much force on a strap for the adjacent tail and cause it to potentially get jammed. The inside diameter of strap 484 may be larger than the outside diameter of tubular 100 and the inside diameter of straps 485 and 486 may be larger than the outside diameter of buoyancy module 402A so that fairing 425 can rotate freely around buoyancy module 402A. Note that, if desired, strap 486 could be modified to be below buoyancy module 402A and have an inside diameter similar to strap 484. Thus, fairing 425 illustrates that the straps of a fairing may reside outside the buoyancy diameter, outside the ends of the buoyancy, or both.

Still referring to FIG. 4A, fairing 427 is similar to fairing 423 in that both of its straps 487 reside in grooves 403. However fairing 423 may have two tails 428A and 428B which are typically (but not required to be) rigidly or flexibly connected. Straps 487 may have an inside diameter that is larger than the inside diameter of grooves 403 so that fairing 427 is free to rotate around buoyancy module 402B. Fairing 423 may include any number of tails and any number of straps but will have at least one tail and at least one strap. A single tail will typically have at least one strap attached to it but may not have any straps attached to it if it is attached to one or more adjacent tails.

Still referring to FIG. 4A, fairing tails 422A, 422B, 424, 426A, 426B, 428A, and 428B may be of any suitable quantity, size, or shape and may be made of any suitable material including, but not limited to, plastic, metal, fiberglass, elastomer or rubber, synthetic, or composite. Full fairings, helical strakes, or other VIV suppression or drag reducing devices that completely shroud the underlying buoyancy module may be substituted for any of the fairing tails. Straps 481, 483, 484, 485, 486, 487 and 488 and double strap 482 may be made of any suitable size, shape or geometry and may be made of any suitable material including, but not limited to, plastic, metal, fiberglass, elastomer or rubber, synthetic, or composite. Materials may be mixed and matched as suitable.

Figure 4B:
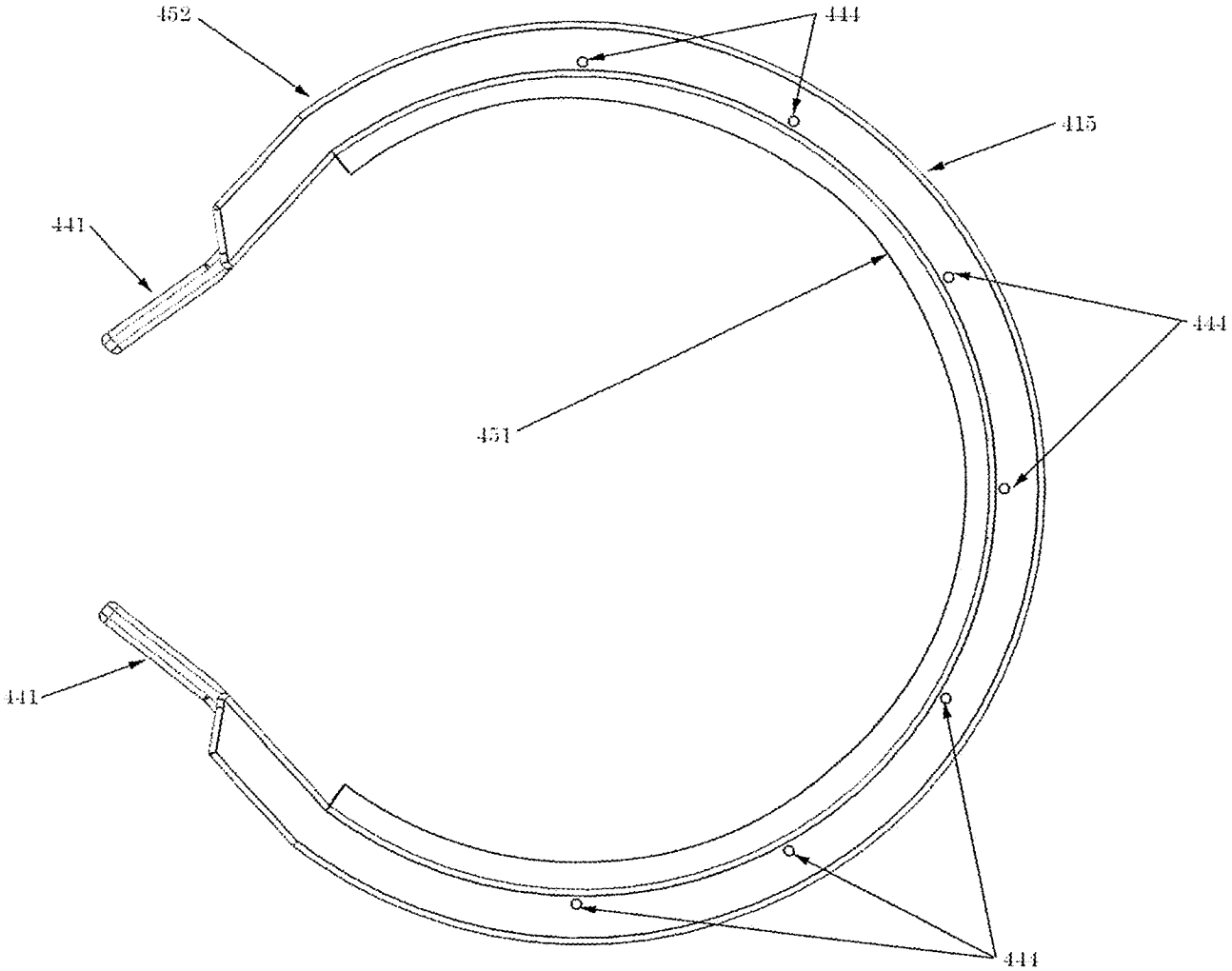
FIG. 4B is a top view of a tail fairing strap with an inner flange.

Referring now to FIG. 4B, strap 485 may have an outer flange 452, connection ends 441, inner flange 451, and openings 444.

Again referring to FIG. 4B, this figure illustrates that inner flange 451 may be inserted into a buoyancy module groove or in the gap (space) between adjacent buoyancy modules instead of inserting the entire strap 485 in the groove or gap. Inner flange 451 and outer flange 452 are shown as somewhat continuous on strap 485 but may include discrete segments that may each have different shapes and sizes. For example, inner flange 451 may include discrete segments around the inside of inner flange 451 and the segments need not be uniform in length. Any number of inner flanges 451 or outer flanges 452 may be present and both inner flange 451 and outer flange 452 are optional with inner flange 451 normally used to ride in a groove or provide additional structural stiffness and outer flange 452 primarily used to provide additional structural assistance or a location for openings 444 that does not adversely affect the structural integrity of strap 485. Openings 444 may be used for drainage of water as strap 485 enters and exits the water but may also be used for handling, weight reduction, and other purposes. Strap 485 may be hinged to facilitate installation, storage, or handling. Openings 444 may be of any suitable size or shape. Connection ends 441 may be of any suitable size and shape and may, or may not, have the same cross sectional shape as the rest of strap 485. Strap 485, and all other straps described herein, may be attached to a fairing tail or other VIV suppression device or component by any suitable means including, but not limited to, bolting, screwing, clamping, welding, pinning, riveting, adhesives or chemical bonding, molding (where the strap may be molded with the tail or an appurtenance may be molded into the tail for attaching a strap), or any combination thereof.

Still referring to FIG. 4B, strap 485, inner flange 451, outer flange 452, and connection ends 441 may be made of any suitable material, including, but not limited to, plastic, metal, fiberglass, elastomer or rubber, synthetic, or composite. Materials may be mixed and matched as suitable.

Figure 4C:
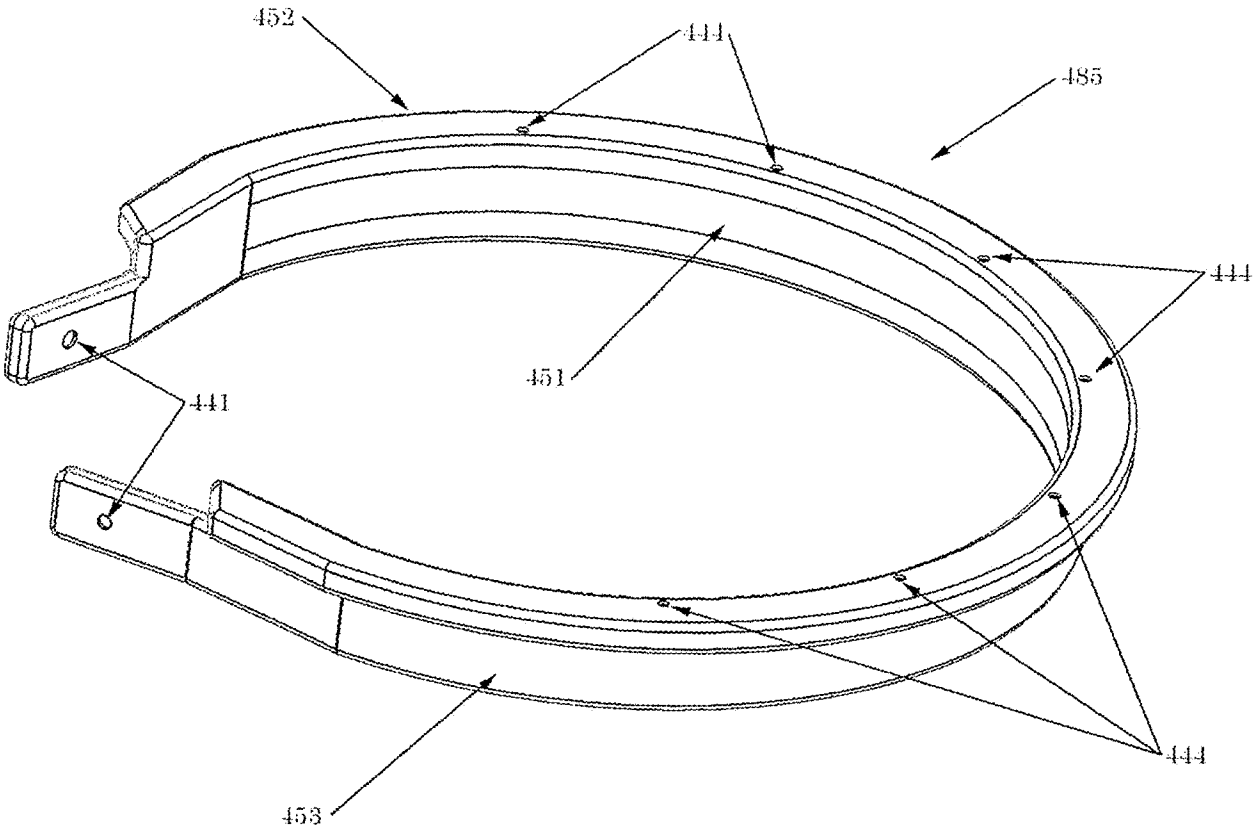
FIG. 4C is a perspective view of a tail fairing strap with an inner flange.

Referring now to FIG. 4C, strap 485 has outer flange 452, connection ends 441, inner flange 451, web 453, and openings 444.

Again referring to FIG. 4C, this figure is similar to FIG. 4B but shows a perspective view of strap 485. Any number of outer flanges 452 or inner flanges 451 may be present and each flange may be located in any suitable position relative to web 453. Inner flange 451 and outer flange 452 may have any suitable geometry and may have short segments that may vary in length. Inner flange 451 and outer flange 452 may be molded as part of web 453 or may be appurtenances that are added to web 453 by any suitable attachment means. Both inner flange 451 and outer flange 452 are optional. In general, when inner flange 451 is present it may be used to support strap 485 and its associated fairing tail by insertion of inner flange 451 into a buoyancy module groove or in the gap between buoyancy modules.

Still referring to FIG. 4C, web 453 may be of any suitable size and shape and may be made of any suitable material.

Figure 4D:
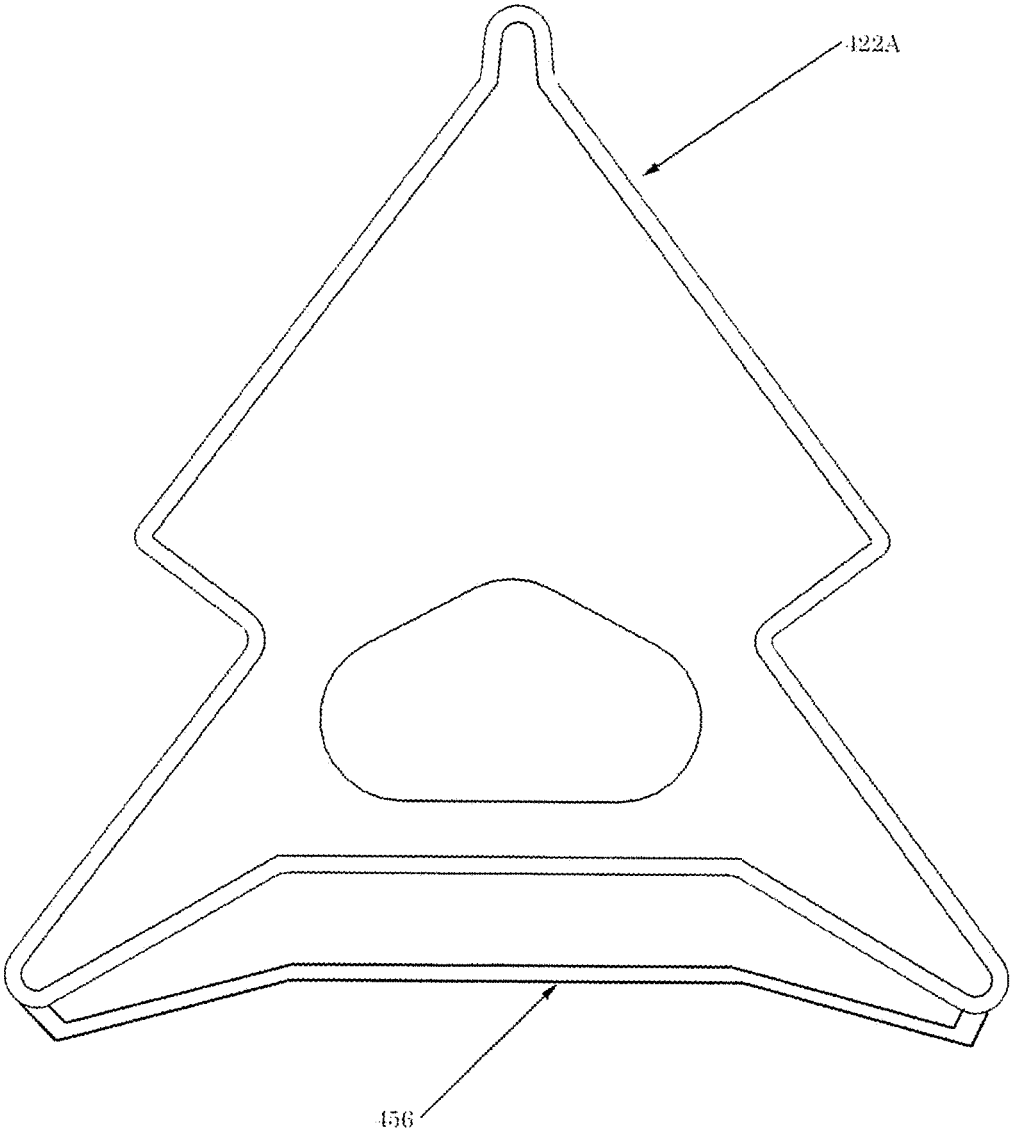
FIG. 4D is a top view of a fairing tail with a front flange.

Referring now to FIG. 4D, a top view of tail 422A is shown with flange 456. Flange 456 may be molded into tail 422A or may be a separate structure that is attached to tail 422A by any suitable means. Flange 456 may be of any suitable size or shape. Flange 456 may be dimensioned such that it can be inserted into a buoyancy module groove or in the gap between adjacent buoyancy modules. In addition, flange 456 may be dimensioned to rotate around the underlying buoyancy module with flange 456 supporting the weight of tail 422A and assisting with keeping tail 422A adjacent to the underlying buoyancy module, especially when used in conjunction with a strap having an internal flange such as shown in FIGS. 4B and 4C. Flange 456 may be made of any suitable material such as those noted herein.

Figure 4E:
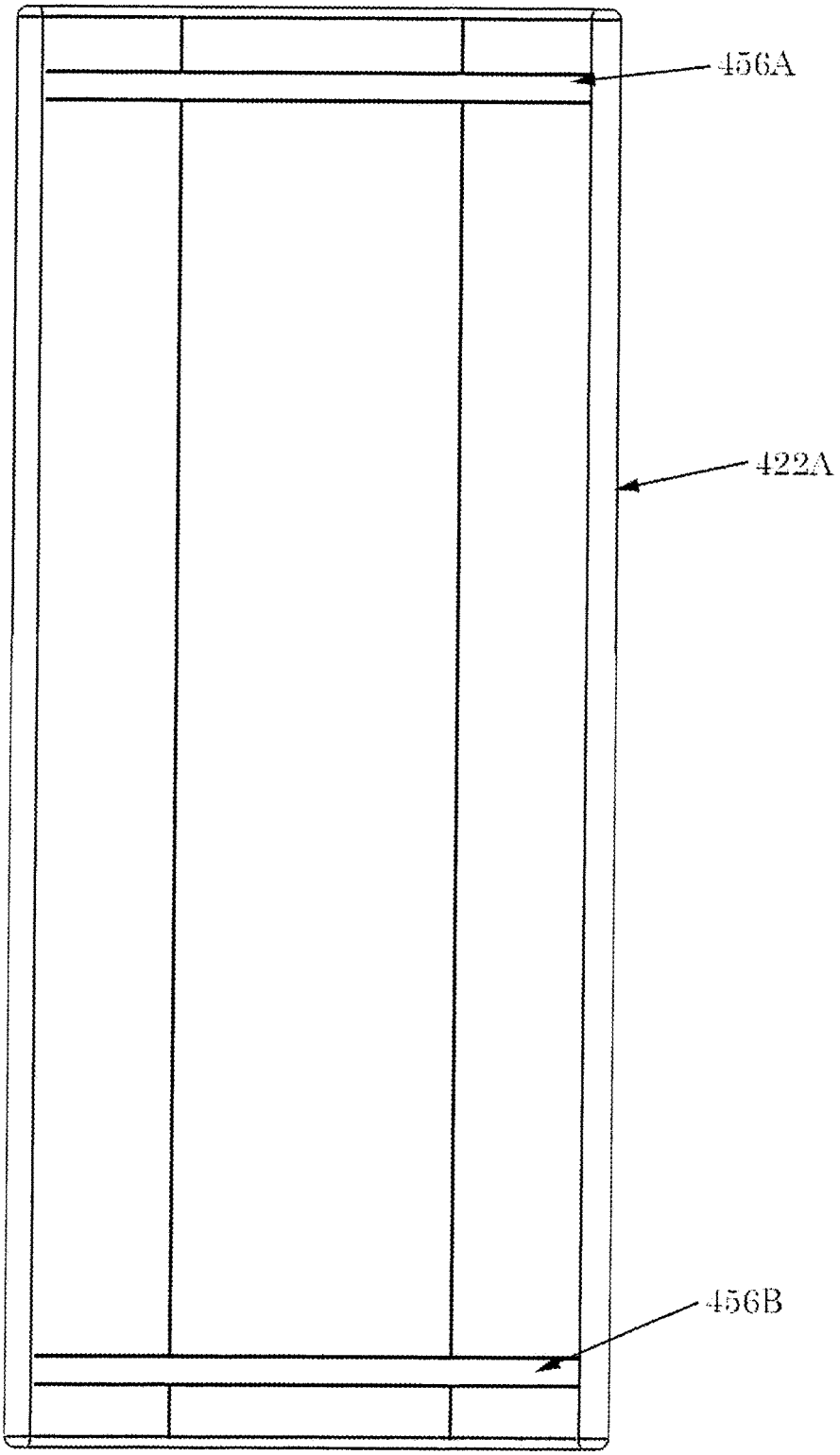
FIG. 4E is a front view of a fairing tail with two front flanges.

Referring now to FIG. 4E, a front view of tail 422A is shown with flanges 456A and 456B. FIG. 4E illustrates that any number of flanges 456A and 456B may be used. For example, flange 456A may reside in one groove in an underlying buoyancy module while flange 456B may reside in a different groove in the same underlying buoyancy module or in a different (adjacent) buoyancy module.

Figure 5:
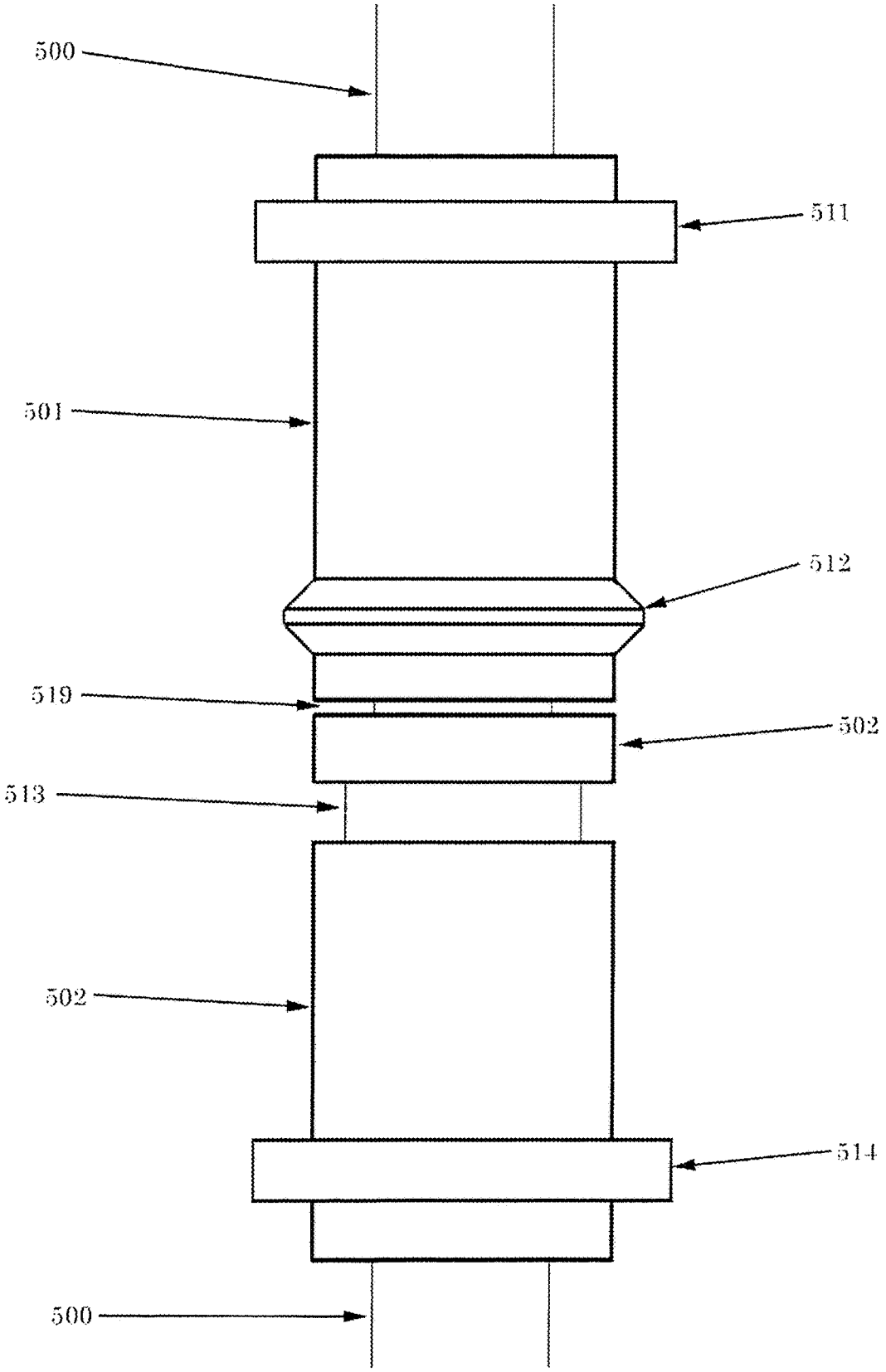
FIG. 5 is a side view of a tubular with alternative buoyancy modules having surface protrusions.

Referring now to FIG. 5, buoyancy modules 501 and 502 are shown attached to underlying tubular 500 and separated by gap 519. Buoyancy module 501 has an engaging member extending from an outer surface of the module 501. For example, the engaging member could be a protrusion such as a rectangular flange 511 and/or tapered flange 512. Buoyancy module 502 has groove 513 and rectangular flange 514.

Again referring to FIG. 5, this figure illustrates buoyancy alterations that result in protrusions in the buoyancy module surface that, for example, create rectangular flanges 511 and 514 or tapered flange 512, which may be used to support a VIV suppression device. An optional collar may be attached to rectangular flanges 511 and 514 or tapered flange 512 (by any suitable means) to support a VIV suppression device or the VIV suppression device may be supported directly by rectangular flanges 511 and 514 or tapered flange 512.

Still referring to FIG. 5, while rectangular flanges 511 and 514 and tapered flange 512 are shown, the flanges may be of any suitable shape or size. Rectangular flanges 511 and 514 are a simple shape to support a fairing and act like a collar but tapered flange 512 may be more useful in passing the buoyancy module through another structure or opening during installation. Thus, the shape and size may be customized depending upon the needs of an actual application. If a collar or other support structure is attached to rectangular flanges 511 and 514 or tapered flange 512, the collar may be purposely modified in shape or size to mate with the adjacent flanges. For example, while most collars include some kind of web portion that is adjacent to the underlying structure and a flange portion that supports a suppression device (such as a fairing), when used with rectangular flanges 511 and 514 or tapered flange 512 the collar may include a simple flat ring that is attached to rectangular flanges 511 and 514 or tapered flange 512. It should be noted that the collar may include one or more segments that may be attached to each other or optionally to one or more buoyancy module flanges, by any suitable means.

Still referring to FIG. 5, buoyancy module 502 has both a groove 513 and a rectangular flange 514 illustrating that both concepts may be used at once even on a single buoyancy module. This type of module can utilize rectangular flange 514 (or a flange of any other suitable shape) to support most of the buoyancy module weight and a strap in groove 513 to assist with fairing rotating or for keeping the fairing in place when it is slightly buoyant and thus wants to rise vertically.

Still referring to FIG. 5, rectangular flanges 511 and 514, tapered flange 512, and groove 513 may be of any suitable size or shape. Rectangular flanges 511 and 514 and tapered flange 512 may be made of any suitable material and may be part of the buoyancy module or may be structures that are separately attached to the buoyancy module, with the attachment optionally made prior to installation of the underlying tubular. Mux clamps, anode bracelets, connectors, or other structures or appurtenances on the tubular or on the buoyancy module may be used in conjunction with, or in place of, rectangular flanges 511 or 514, tapered flange 512, or groove 513.

Figure 6A:
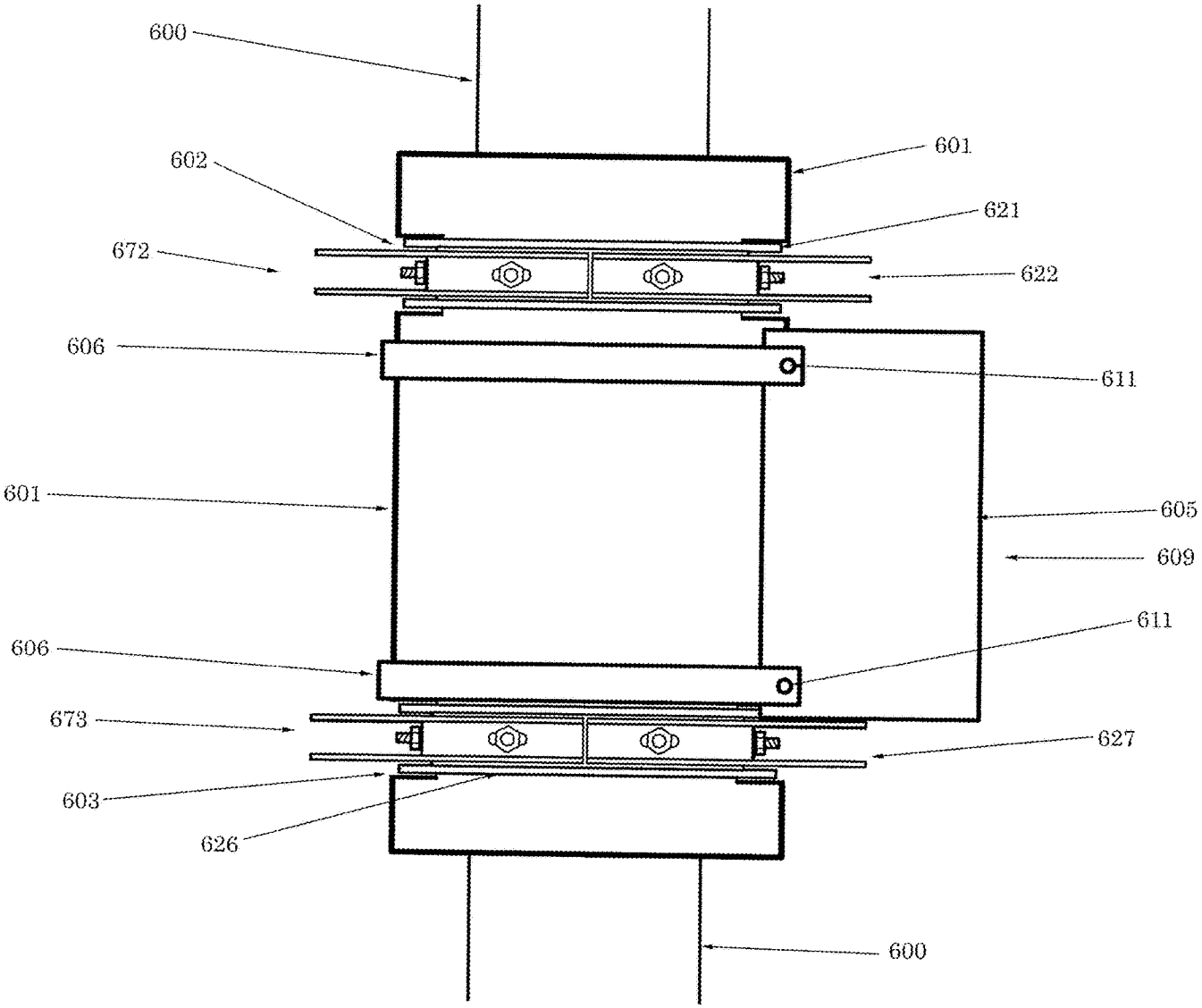
FIG. 6A is a side view of a buoyancy module with grooves and a tail fairing with two collars.

Referring now to FIG. 6A, FIG. 6A shows buoyancy module 601, having grooves 602 and 603, on tubular 600. In addition, collars 672 and 673 are attached to tubular 600. Collar 672, may have outer collar section 622 which is on top of inner collar section 621 which is, in turn, on top of groove 602. Similarly, collar 673 may have outer collar section 627 which is on top of inner collar section 626 which is, in turn, on top of groove 603. Tail fairing 609 may include tail 605 and straps 606 and is restrained axially by the collars. Straps 606 are attached to tail 605 by pins 611.

Again referring to FIG. 6A, grooves (or channels) 602 and 603 provide a location for semi-permanently attaching inner collar sections 621 and 626 so that these collar sections can be pre-installed prior to installation of the riser. Outer collar sections 622 and 627 are then installed on the drilling rig after the diverter but above the water surface.

Still referring to FIG. 6A, any number of grooves 602 and 603 may be present on a buoyancy module 601, and any number of inner collar sections 621 and 626 may be present on buoyancy module 601. Any number of tail fairings 609 may be present on a buoyancy module 601 and one, none, or multiple tail fairings 609 may be present between adjacent collars 672 and 673. Collars 672 and 673 may be installed in grooves 602 and 603 or may be installed on other areas of buoyancy module. In some cases, a riser joint may have multiple buoyancy modules 601 and some modules may have grooves 602 and 603 and other modules may not have any grooves at all. Collars 672 and 673 may have any number of inner collar sections 621 and 626 as well as any number of outer collar sections 622 and 627. Collars 672 and 673 may be attached to, clamped to, or held adjacent to buoyancy module 601 by any suitable means. Buoyancy module 601 may be of any suitable geometry but will have one or more channels or grooves present.

Still referring to FIG. 6A, inner collar sections 621 and 626, outer collar sections 622 and 627, tail 605, and straps 606 may be made of any suitable material including, but not limited to, plastic, metal, fiberglass or other composite, synthetic, rubber or elastomer, or wood. Each component or section may be made of the same material or may be made of a different material. Materials may be mixed and matched as desired.

Figure 6B:
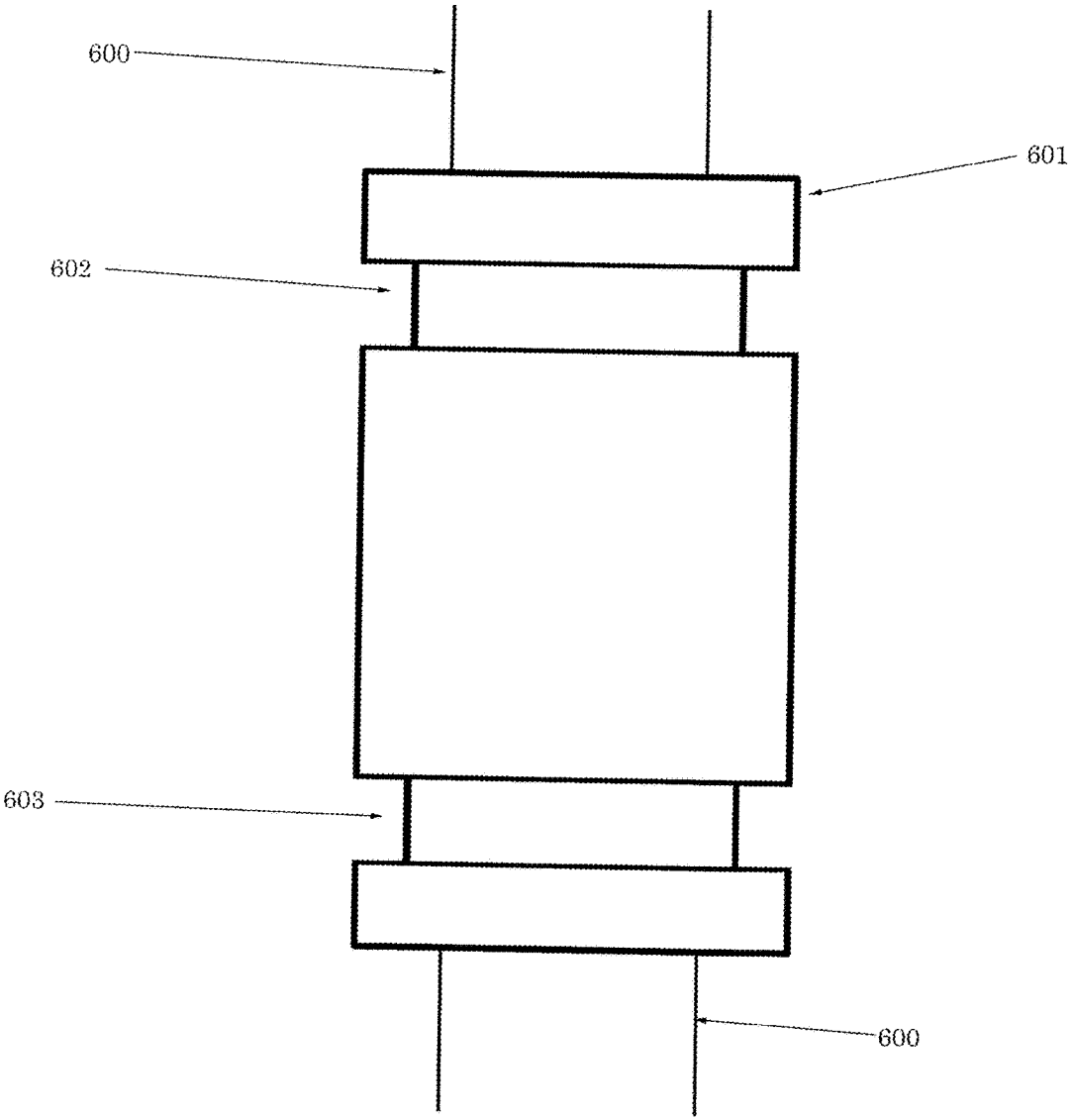
FIG. 6B is a side view of a buoyancy module with grooves.

Referring now to FIG. 6B, buoyancy module 601 is shown on tubular 600 and having grooves (i.e. channels) 602 and 603 in its surface.

Again referring to FIG. 6B, any number of grooves 602 and 603 may be present in buoyancy module 601 and grooves 602 and 603 may have any suitable geometry. For example, grooves 602 and 603 may or may not extend around the full circumference of buoyancy module 601. Similarly, grooves 602 and 603 may run diagonally or even vertically across buoyancy module 601, or simply consists of pockets rather than grooves.

Figure 6C:
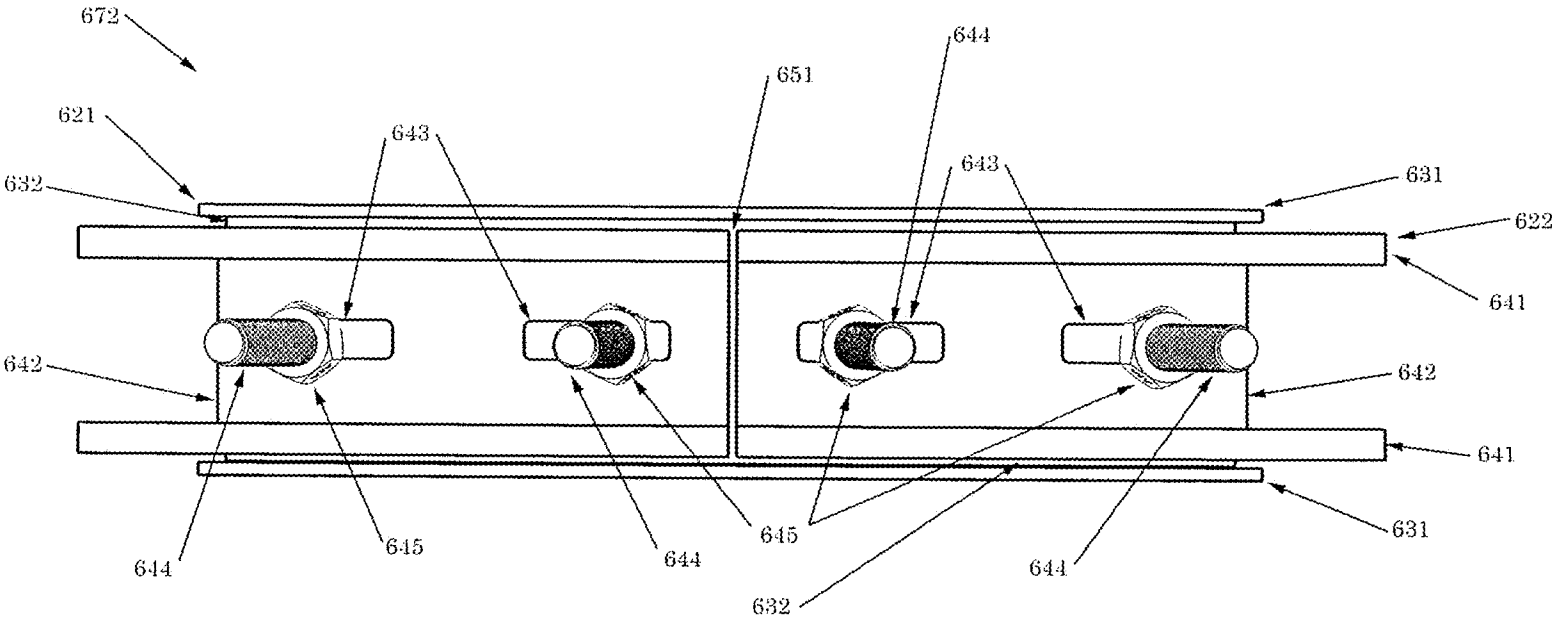
FIG. 6C is a side view of a collar having an inner section and an outer section.

Still referring to FIG. 6C, buoyancy module 601 may have any number of components or sections, and may be attached to tubular 600 by any suitable means (tubular 600 may also consist of multiple tubulars as is common for drilling risers). Buoyancy module 601 may be of any suitable shape and may have other appurtenances not shown or described herein.

Referring now to FIG. 6C, collar 672 may include inner collar section 621 and outer collar section 622. Inner collar section 621 has flanges 631 and web 632. Outer collar section 622 has flanges 641 and web 642. Slots 643 in web 642 allow for web bolts 644 to protrude through the outer collar section 622 to connect outer collar section 622 to inner collar section 621. Web bolts 644 are tightened down using web nuts 645. Outer collar section 622 may further include gap 651.

Again referring to FIG. 6C, slots 643 allow for outer collar section 622 to be placed around inner collar section 621. For example, outer collar section 622 may be hinged on the back side (i.e. hinge not shown) and wrapped around inner collar section 621, leaving gap 651. Since web bolts 644 extend through inner collar section 621 and are therefore fixed, slots are required in outer collar section 622 so that it may be fitted over web bolts 644. Also, as can be seen in FIG. 6C, outer collar section 622 resides inside of inner collar section 621, so that flanges 641 are inside of flanges 631.

Still referring to FIG. 6C, flanges 631 and flanges 641 may be of any suitable size or shape, and are intended to act as bearing surfaces for an adjacent fairing or other device such as a VIV suppression device. Flanges 631 are optional since only web 632 is needed to hold web bolts 644. Similarly, webs 632 and web 642 may be of any suitable size or shape. Slots 643 may also be of any suitable size or shape and typically will be sufficiently large to allow web bolts 644 to protrude through them and for outer collar section 622 to be fitted over them, but sufficiently small to allow for a nut or a washer to be utilized to constrain outer collar section 622. Any number of slots 643, web bolts 644, and web nuts 645 may be used and, as noted above, washers and other fasteners can be used with web bolts 644 or web nuts 645. Other fastening methods may be used in conjunction with, or in place of, one or more of web bolts 644 or web nuts 645 including, but not limited to, other fasteners and types of nuts, rivets, clamps, chemical bonding, heat welding, and lynch pins or other types of pins. Fastening methods may be mixed and matched as desired.

Still referring to FIG. 6C, flanges 631 and 641, webs 632 and 642, web bolts 644, and web nuts 645 may be made of any suitable material including, but not limited to, metal, plastic, rubber or other elastomer, wood, fiberglass or other composite, or synthetics. Each component may be made of a different material and materials may be mixed and matched as desired. Components may also be made of more than one material.

Figure 6D:
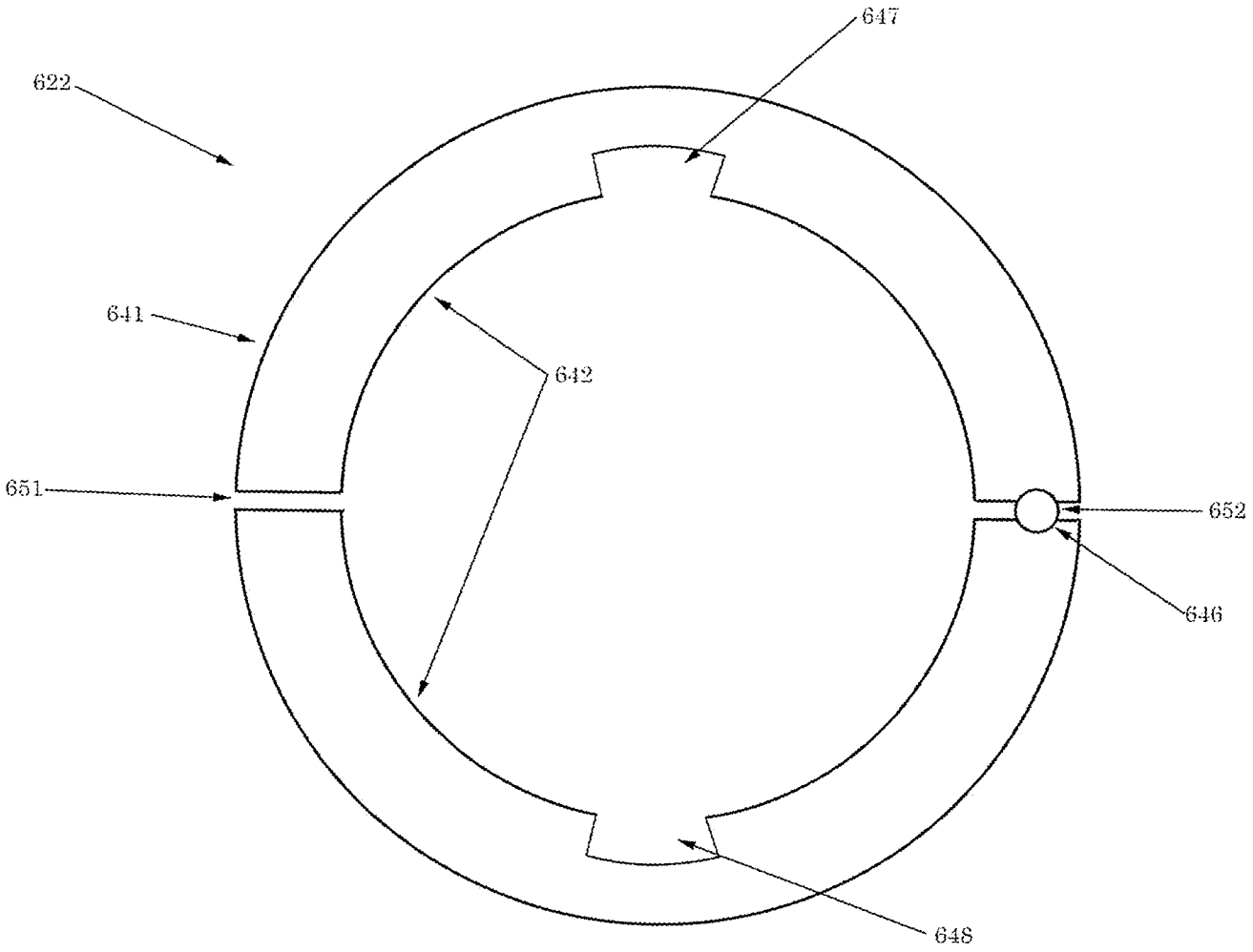
FIG. 6D is a top view of an outer collar section that is hinged.

Referring now to FIG. 6D, outer collar section 622 is shown having flanges 641 and web 642, and two halves separated by gaps 651 and 652. The two halves at gap 652 are connected using hinge 646. Openings 647 and 648 allow for outer collar section 622 to be fitted over an inner collar section having bolt faces or other appurtenances. Outer collar section 622, flanges 641, and web 642 do not have to be round. For example, outer collar section 622, flanges 641, and web 642 may have flat sections on them to mimic typical offshore buoyancy.

Again referring to FIG. 6D, outer collar section 622 is designed to mate with an inner collar section so that, while the inner collar section may be pre-installed, the outer collar section is run at the same time as the fairings and thus mates quickly and easily to the inner collar section. Hinge 646 is optional but is used to allow for faster installation of outer collar section 622. Hinge 646 may be any suitable hinge of any suitable size and shape and any number of hinges 646 may be used with outer collar section 622. Gap 651 may be left open or may be closed with any suitable device such as a latch or a bolt. Openings 647 and 648 may be of any suitable size or shape and any number of openings 647 or 648 may be present. Openings 647 and 648 may be identical in size and shape or may have a different size or shape. Often an inner collar section will have bolt faces for attaching it to an underlying tubular and thus openings 647 and 648 may be required for outer collar section 622 to fit properly over an inner collar section. Outer collar section may have other openings for example to accommodate nuts used to attach web bolts 644 in FIG. 6*c* to an inner collar section. Hinge 646 may be made of any suitable material.

Figure 6E:
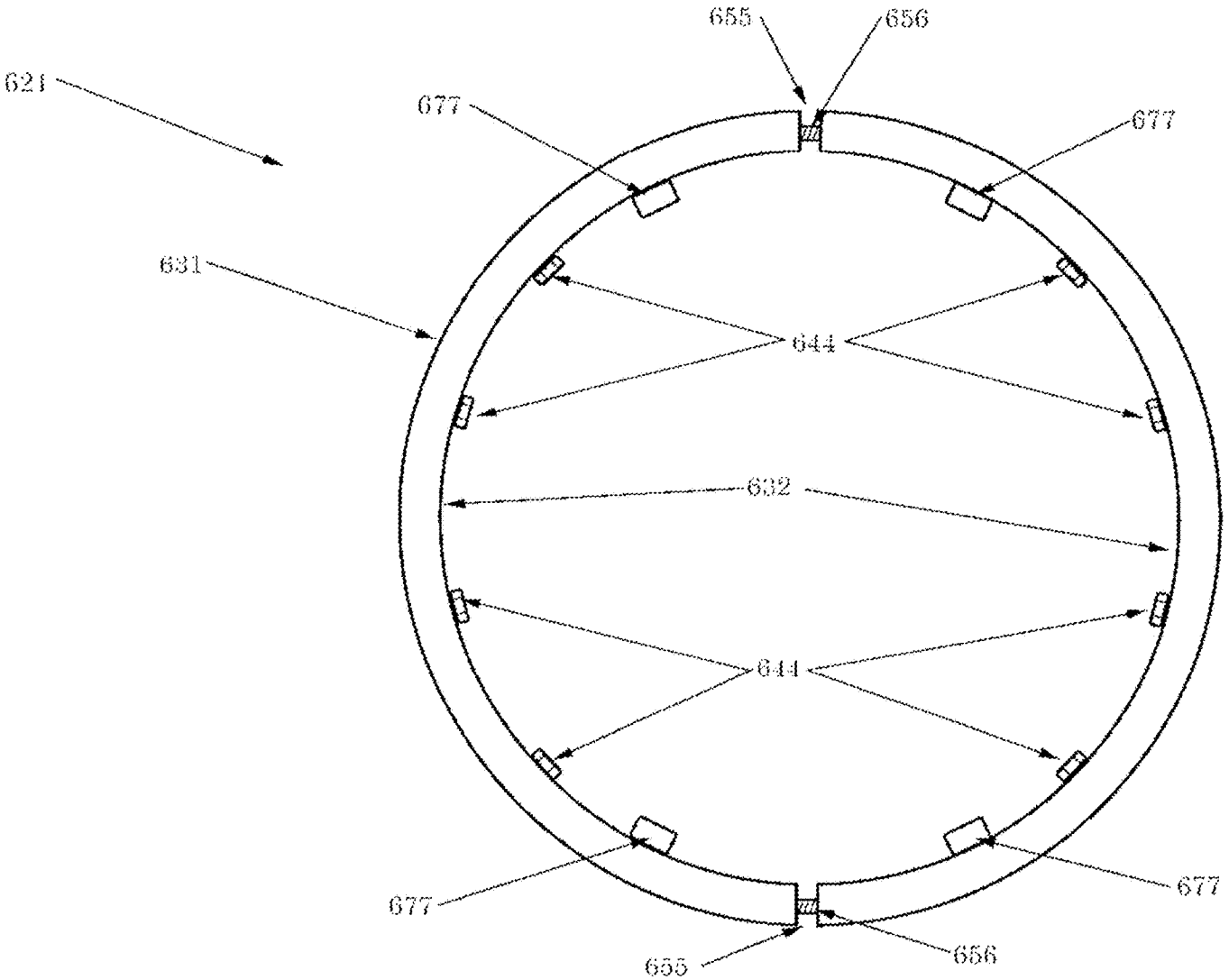
FIG. 6E is a top view of an inner collar section.

Referring now to FIG. 6E, inner collar section 621 is shown having flanges 631 (e.g., upper and lower flanges) and web 632, and in two halves with gaps 655 that are connected by collar bolts 656. Web bolts 644 are shown extending outward from web 632. Springs 677 extend inward from web 632.

Again referring to FIG. 6E, inner collar section 621 is made to be inserted first into a groove and fastened or clamped into place and made to mate with an outer collar section. In this figure, collar section 621 is shown in two halves but can be made in any number of sections. While the two halves of collar section 621 are shown to be connected by collar bolts 656, other connection methods may be used including, but not limited to, welding, riveting, clamping, cabling, and chemical bonding. In addition, it is also possible to band collar section 621 against the underlying buoyancy. Springs 677 are optional and can be used to accommodate changes in the buoyancy diameter due to hydrostatic pressure and still keep inner collar section 621 tight against the buoyancy. Inner collar section 622, flanges 631, and web 632 do not have to be round. For example, inner collar section 621, flanges 631, and web 632 may have flat sections on them to mimic typical offshore buoyancy.

Still referring to FIG. 6E, web bolts 644 are shown extending from the inside of web 632 outward. Web bolts 644 may be countersunk or may extend into the inside of web 632. Springs 677 may be made in any suitable manner and are designed to compress when inner collar section 621 is tight against the underlying buoyancy. Any number of web bolts 644, springs 677, collar bolts 656 may be present and they may be of any suitable size or shape. Web bolts 644, springs 677, and collar bolts 656 may be made of any suitable material including, but not limited to, plastic, rubber or elastomer, metal, fiberglass, or any combination thereof. Springs 677 may be attached to web 632 by any suitable means and may extend into web 632. Part of springs 677 may pass through web 632. Springs 677 may be used at other locations on inner collar section 621 including on the outside of flanges 631 or on collar bolts 656 or web bolts 644.

Figure 7:
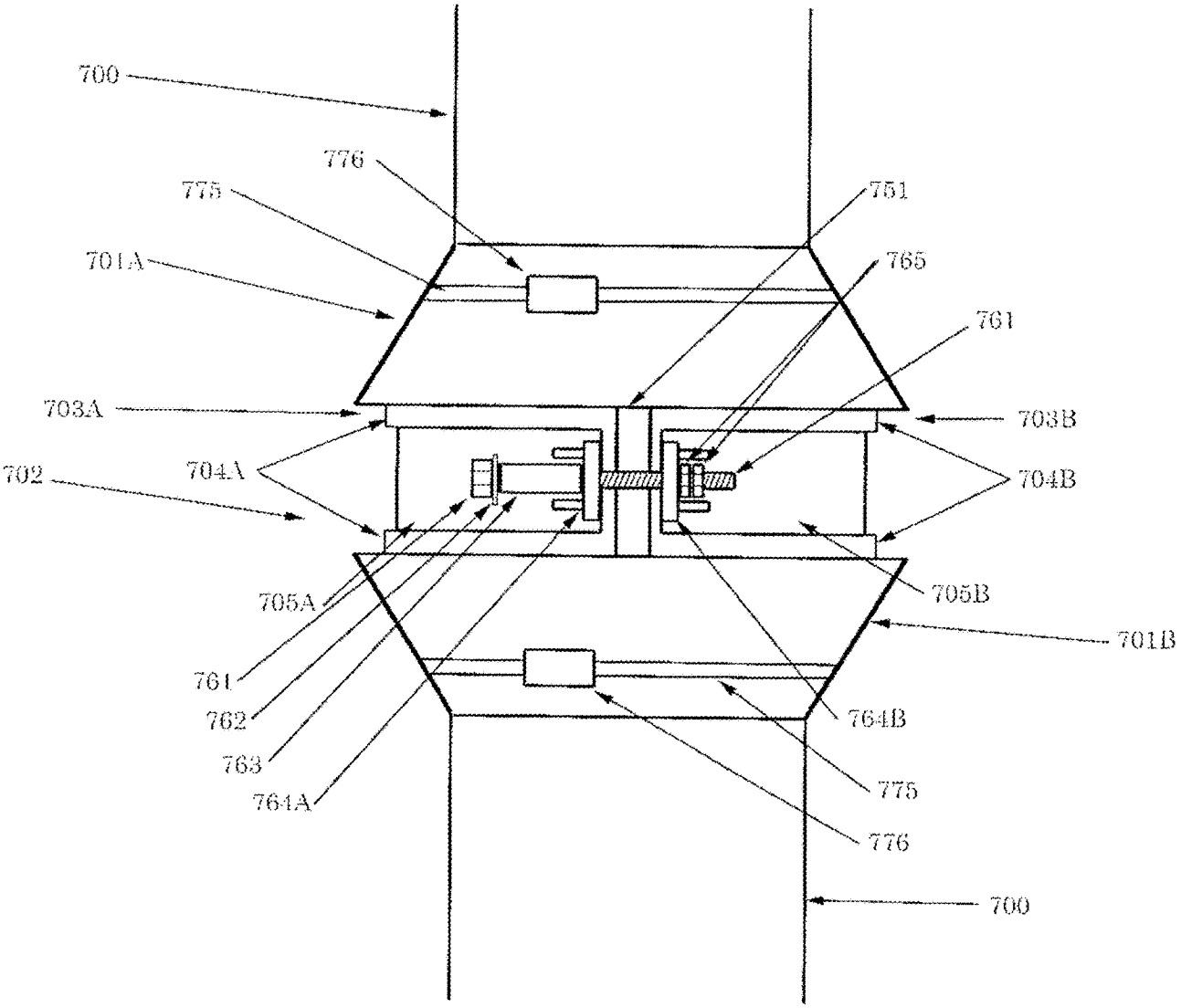
FIG. 7 is a side view of a collar with removable guides.

Referring now to FIG. 7, collar 702 is shown positioned on buoyancy module 700 and may include a left collar half 703A and a right collar half 703B that are separated by gap 751. Left collar half 703A has flanges 704A and web 705A while right collar half 703B has flanges 704B and web 705B. Left collar half 703A and right collar half 703B are attached using collar bolt 761 and collar nuts 765. Collar washer 762 and collar spring 763 are also on collar bolt 761. Bolt plate 764A is attached to web 705A and bolt plate 764B is attached to web 705B. Collar protectors 701A and 701B also reside on buoyancy module 700 and are clamped down using bands 775 and buckles 776.

Again referring to FIG. 7, collar 702 is bolted tight against buoyancy module 700 while collar protectors 701A and 701B are banded tight against buoyancy module 700. When buoyancy module 700 is lowered through a diverter housing or past other structures, collar protectors 701A and 701B protect collar 702 from damage. Collar protectors 701A and 701B are made to be quickly attached or removed.

Still referring to FIG. 7, collar protectors 701A and 701B may be of any suitable shape and will usually, but not necessarily, have internal structures for support. Collar protectors 701A and 701B may be located anywhere relative to collar 702. Collar protector 701A may be present without collar protector 701B present and vice versa. Collar protectors 701A and 701B may be attached to, or clamped against, buoyancy module 700 by any suitable means including, but not limited to, bolting, fastening, clamping, or use of intermediate structures, grooves, or pockets as discussed herein for other collar structures. Collar protectors 701A and 701B may be attached to or pressed against collar 702 in conjunction with, or in place of, attachment to buoyancy module 700. Collar protectors 701A and 701B may be made to be removed at some stage during the installation of the VIV suppression system or may be left on buoyancy module 700 or collar 702 permanently. Collar protectors 701A and 701B may be made of any suitable material including, but not limited to, plastic, metal, rubber or other elastomer, or fiberglass or other composite. Collar protectors 701A and 701B may be made of more than one material.

Figure 8A:
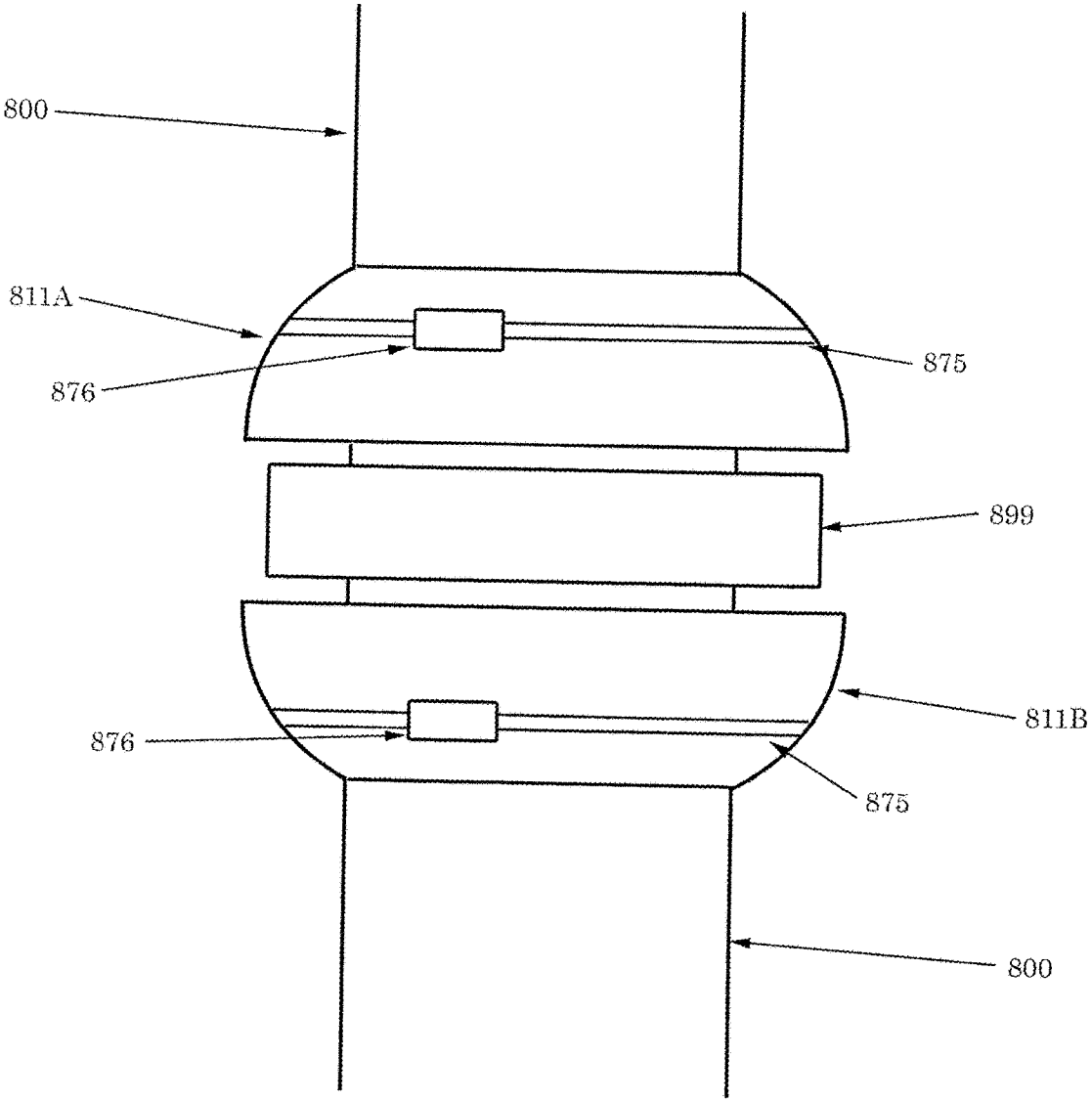
FIG. 8A is a side view of a buoyancy protrusion with removable guides.

Referring now to FIG. 8A, buoyancy protrusion 899, collar protector 811A and collar protector 811B are shown on buoyancy module 800. Bands 875 with buckles 876 are shown on collar protectors 811A and 811B.

Again referring to FIG. 8A, collar protectors 811A and 811B have a different shape than those shown in FIG. 7 but are still made to protect a collar or, in this case, a buoyancy protrusion. Buoyancy protrusion 899 may be of any suitable shape but generally includes an outward extension of the buoyancy so as to act like a collar to provide axial restraint or bearing support for a fairing or other VIV suppression device. Buoyancy protrusion 899 may be part of the buoyancy, part of the buoyancy coating, or a separate structure connected to or tightened against buoyancy module 800. Collar protectors 811A and 811B may protect any number buoyancy protrusions 899 and any number of collar protectors 811A and 811B may be used on buoyancy module 800. Buoyancy protrusion 899 may be of any suitable material including, but not limited to, syntactic foam, plastic, fiberglass, metal, rubber or elastomer, or any combination thereof. Collar protectors 811A and 811B may be of any suitable material including, but not limited to, plastic, metal, fiberglass, rubber or elastomer, syntactic foam, or any combination thereof. Collar protectors 811A and 811B may be of any suitable shape and may be banded or bolted or attached to, or held against, buoyancy module 800 by any suitable means.

Figure 8B:
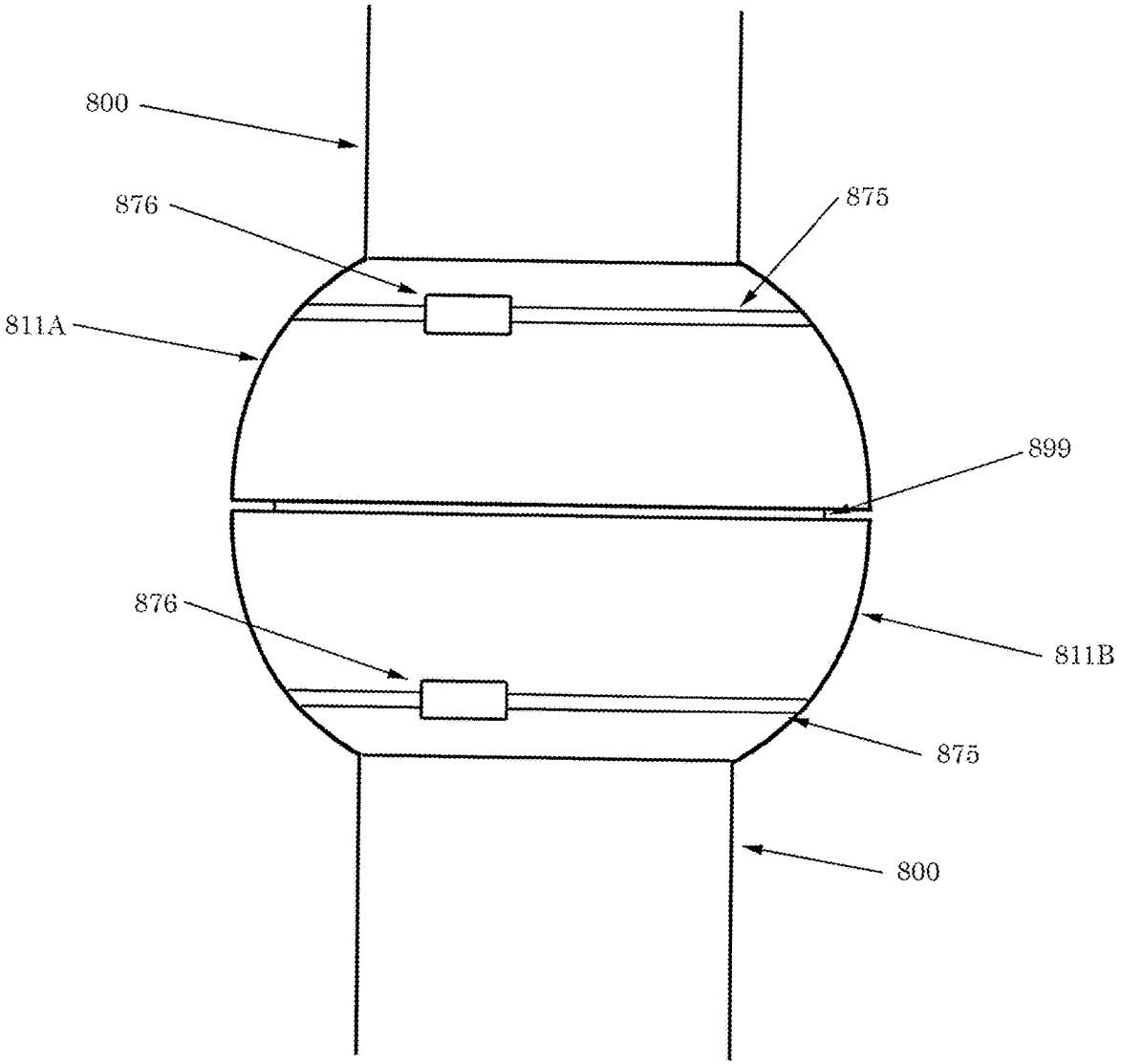
FIG. 8B is a side view of a buoyancy protrusion that is mostly covered by removable guides.

Referring now to FIG. 8B, buoyancy protrusion 899, collar protector 811A and collar protector 811B are shown on buoyancy module 800. Bands 875 with buckles 876 are shown on collar protectors 811A and 811B.

Again referring to FIG. 8B, this figure is identical to FIG. 8A except that collar protectors 811A and 811B are closer together and almost fully cover buoyancy protrusion 899. This figure illustrates that collar protectors 811A and 811B may each be located relative to buoyancy protrusion 899 and relative to each other in any suitable location or distance.

The above aspects of this invention may be mixed and matched in any manner suitable to achieve the purposes of this invention. For example, springs may also be used with any of the fastening or coupling methods described herein. Other VIV suppression devices, drag reduction devices, or tubular monitoring devices may be substituted for the tail fairings described herein which are used as an example. Insulation or other tubular covers may be substituted for the buoyancy module. The buoyancy modules may have other openings or appurtenances such as openings for receiving auxiliary lines or tubulars.

In broad embodiments, the present invention consists of alterations to a tubular cover such as buoyancy such as the addition of grooves, channels, gaps, or protruding flanges, or the addition of a collar having one or more inner sections and one or more outer sections, to axially restrain a VIV suppression device, drag reduction device, VIV monitoring device, or a component of such a device to improve the performance of that device or one or more of its components.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. For several of the ideas presented herein, one or more of the parts may be optional. The invention should therefore not be limited by the above described embodiment, method, and examples, but by all embodiments and methods within the scope and spirit of the invention.

The above aspects of this invention may be mixed and matched in any manner suitable to achieve the purposes of this invention. Springs may also be used with any of the fastening or coupling methods described herein. Collar-type supports such as clamps, rings, anode bracelets, connectors, other suppression devices that are held tight against the underlying tubular, etc. may be used in place of the collar throughout this application.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. For several of the ideas presented herein, one or more of the parts may be optional. The invention should therefore not be limited by the above described embodiment, method, and examples, but by all embodiments and methods within the scope and spirit of the invention.

What is claimed is:

1. A vortex induced vibration suppression system comprising:

a buoyancy module having an overall cylindrical shape dimensioned to encircle an underlying tubular, the buoyancy module having an exterior surface and a groove formed inwardly from the exterior surface; and a collar dimensioned to at least partially encircle the underlying tubular, the collar having a web and at least one annularly shaped flange extending from the web, and at least one engaging member dimensioned to engage with the buoyancy module, when the collar is positioned around the underlying tubular.

2. The vortex induced vibration suppression system of claim 1 wherein the groove is dimensioned to receive the collar.

3. The vortex induced vibration suppression system of claim 1 wherein the groove comprises a sidewall, and an axially oriented slot for engaging with the engaging member of the collar is formed in the sidewall.

4. The vortex induced vibration suppression system of claim 1 wherein the engaging member is a spring that extends from a top side or a bottom side of the collar.

5. The vortex induced vibration suppression system of claim 1 wherein the buoyancy module is a first buoyancy module, the system further comprising a second buoyancy module, and wherein the engaging member of the collar is dimensioned to engage with a gap between the first buoyancy module and the second buoyancy module.

6. The vortex induced vibration suppression system of claim 5 wherein the engaging member extends from the web in a radial direction, toward the underlying tubular, and is dimensioned to be inserted within the gap.

7. The vortex induced vibration suppression system of claim 1 wherein the flange is a first flange and the collar further comprises a second flange that together form a set of inner flanges, and the collar further comprises a set of outer flanges.

8. The vortex induced vibration suppression system of claim 7 wherein the set of outer flanges are hinged to the set of inner flanges, and the outer flanges are operable to be retracted or extended to change an overall flange length of the collar.

9. The vortex induced vibration suppression system of claim 1 wherein the buoyancy module further comprises a protruding member extending from an outer surface of the buoyancy module, wherein the protruding member is dimensioned to support a VIV suppression device.

10. The vortex induced vibration suppression system of claim 1 wherein the collar further comprises a spring extending from a surface of the web facing the underlying tubular.

11. The vortex induced vibration suppression system of claim 1 further comprising a collar protector coupled to the buoyancy module and the collar.

12. A vortex induced vibration suppression system comprising:

a buoyancy module dimensioned to at least partially encircle an underlying tubular, the buoyancy module having an exterior surface, a radially oriented groove formed inwardly from the exterior surface, and an axially oriented slot formed within a sidewall of the groove, wherein the groove is dimensioned to receive a collar, and the slot is dimensioned to engage with a portion of the collar.

13. The vortex induced vibration suppression system of claim 12 further comprising a collar, wherein the collar is dimensioned to at least partially encircle the buoyancy module, the collar having a web, a set of flanges extending from the web, and at least one axially oriented engaging member dimensioned to engage with the axially oriented slot.

14. The vortex induced vibration suppression system of claim 13 wherein the at least one axially oriented engaging member comprises a spring, and wherein the spring is operable to contract when the collar is being inserted into the groove and expand once the spring is aligned with the slot.

15. The vortex induced vibration suppression system of claim 12 wherein the radially oriented groove is formed around an entire circumference of the buoyancy module.

16. The vortex induced vibration suppression system of claim 12 wherein the axially oriented slot is formed around an entire circumference of the buoyancy module.

17. A vortex induced vibration suppression system comprising:

an encircling member having an overall cylindrical shape dimensioned to at least partially encircle an underlying tubular, the encircling member having a receiving member; and a collar dimensioned to at least partially encircle the underlying tubular, the collar having a web and at least one flange that at least partially encircles the tubular, and at least one engaging member dimensioned to engage with the encircling member, when the collar is positioned around the underlying tubular.

18. The vortex induced vibration suppression system of claim 17 wherein the encircling member is a buoyancy module or an insulation member, and the collar is dimensioned to at least partially encircle an exterior surface of the buoyancy module or the insulation member.

19. The vortex induced vibration suppression system of claim 17 wherein the receiving member comprises (1) a groove formed inwardly from an exterior surface of the encircling member, the groove having a sidewall, and an axially oriented slot is formed in the sidewall for engaging with the engaging member of the collar, or (2) a slot formed inwardly from the exterior surface of the encircling member, and the slot comprises a geometry operable to engage with the engaging member.

20. A vortex induced vibration suppression system comprising:

a collar dimensioned to at least partially encircle an underlying tubular and support a vortex induced vibration suppression device, the collar having a web, a set of inner flanges extending from the web, and a set of outer flanges operable to extend radially outward to the inner flanges.

21. The vortex induced vibration suppression system of claim 20 wherein the set of outer flanges are connected to the set of inner flanges, and the outer flanges are operable to be retracted or extended to change an overall flange length of the collar.

22. The vortex induced vibration suppression system of claim 20 further comprising:

a buoyancy module, the buoyancy module comprising a slot; and an engaging member extending from the collar, the engaging member dimensioned to be inserted into the slot, and having a geometry sufficient to secure the engaging member within the slot.

* * * * *